United States Patent [19]

Saitoh

[11] Patent Number: 5,024,640

[45] Date of Patent: Jun. 18, 1991

[54] METHOD AND APPARATUS FOR STORING FLAT-FOLDED CASES IN A PILE, AND FOR OPENING AND SEALING SAID CASES

[75] Inventor: Takashi Saitoh, Tokyo, Japan

[73] Assignees: Nagano Technical Service Co., Ltd., Nagano; Technical Products Co., Ltd., Tokyo, both of Japan

[21] Appl. No.: 530,456

[22] Filed: May 29, 1990

Related U.S. Application Data

[63] Continuation of Ser. No. 256,391, Oct. 11, 1988, abandoned.

[30] Foreign Application Priority Data

Oct. 14, 1987 [JP] Japan ..... 62-259031
Sep. 15, 1988 [JP] Japan ..... 63-231188

[51] Int. Cl.[5] ..... B31B 3/06; B31B 3/72; B31B 3/78

[52] U.S. Cl. ..... 493/127; 493/116; 493/127; 493/125; 493/181; 493/183; 493/317

[58] Field of Search ..... 493/122, 123, 124, 125, 493/126, 127, 181, 183, 116, 117, 316, 317

[56] References Cited

U.S. PATENT DOCUMENTS

| | | | |
|---|---|---|---|
| Re. 30,921 | 5/1982 | McDowell | 483/317 |
| 2,706,935 | 4/1955 | Pasjack | 493/116 |
| 3,420,036 | 1/1969 | Hutchinson | 53/186 |
| 3,430,948 | 3/1969 | Sage | 271/167 |
| 3,982,474 | 9/1976 | Klund | 493/183 |
| 4,160,406 | 7/1979 | Nowacki | 493/125 |
| 4,163,414 | 8/1979 | Bachman et al. | 493/183 |
| 4,285,682 | 8/1981 | Moss | 493/316 |
| 4,579,551 | 4/1986 | Ulrich et al. | 493/316 |
| 4,627,830 | 12/1986 | Smidt | 493/316 |

FOREIGN PATENT DOCUMENTS

| | | |
|---|---|---|
| 2361027 | 6/1975 | Fed. Rep. of Germany . |
| 1502081 | 2/1978 | United Kingdom . |
| 2058706 | 4/1981 | United Kingdom . |

OTHER PUBLICATIONS

Leaflet Concerning "Boxmaster", Published by Itoman Engineering Co., Ltd.

Leaflet Concerning "Carton Sealer SM11", Published by Kyowa Co., Ltd.

*Primary Examiner*—William E. Terrell

*Attorney, Agent, or Firm*—Frishauf, Holtz, Goodman & Woodward

[57] ABSTRACT

A number of cases are stored horizontally in a stack in a magazine. A bottom upper-inner flap of a flat folded case is folded downward to open the case by a flap-folding member while the case is being lifted from a magazine station to a flap-folding station, and while attracted to and held by a suction cup. The case is opened during this lifting and folding step. Once the bottom upper-inner flap has been folded downward, it comes into the space between the bottom outer flaps. The bottom upper-inner flap, which has been folded downward, pushes the left outer flap during the lifting operation. As the case is lifted higher and higher, both outer side flaps are opened simultaneously. The case is therefore gradually opened, during lifting, thereby forming a hollow cylindrical case. The remianing bottom flaps are closed and then sealed.

16 Claims, 33 Drawing Sheets

(A)

(B)

(C)

(D)

(A)

(B)

F2R
F1U
F1L
12C
84
114
119A
123
124
126
128
129

METHOD AND APPARATUS FOR STORING FLAT-FOLDED CASES IN A PILE, AND FOR OPENING AND SEALING SAID CASES

This application is a continuation of application Ser. No. 07/256,391, filed Oct. 11, 1988, now abandoned.

BACKGROUND OF THE INVENTION

1. Field of the Invention

The present invention relates to a method of opening and assembling flat-folded cardboard cases. The invention also relates to a machine for opening and assembling flat-folded cases, and to a mechanism for opening flat-folded cases. Throughout the following description and claims, the term "case" is used to denote a box, carton or the like.

2. Description of the Prior Art

Most corrugated cardboard cases have four panels, two pairs of top flaps, and two pairs of bottom flaps. When they are stored, their panels and flaps are folded flat. To form such a flat-folded corrugated cardboard case into an open case, the flat-folded case is first opened and shaped like a hollow cylinder, then the bottom flaps are folded and sealed, thus forming a bottomed case. Goods are packed into this case through the open top, and top flaps are folded and sealed, so that the packed goods may be shipped.

A case-assembling machine is used to open flat preassembled cases, shape them into open cases, and seal the bottom flaps of these cases. To pack goods into the cases, and to fold and seal the top flaps of these cases, a packaging machine is employed.

Of the bottom flaps of each flat preassembled case, a first pair, which are to be folded first, are called "inner flaps", while a second pair, which are to be folded next, are called "outer flaps." The same naming applies to the top flaps of the flat preassembled case. Of the four main panels of the flat folded case a first two opposing panels to which are connected the inner flaps, both top and bottom, are called "end panels", while a second two opposing panels are called "side panels."

Generally, a flat folded case is formed into an open case and sealed into a bottomed case, in the following steps:

1. First, a compressive force is applied to the flat folded case as is shown in FIG. 38(*a*), thereby opening same into a hollow cylinder as is illustrated in FIG. 38(*b*).

2. Then, the inner bottom flaps, i.e., upper-inner flap F1U and lower-inner flap F1L, are folded inward, as is shown in FIG. 38(*c*), and the bottom outer flaps, i.e., left-outer flap F2L and right-outer flap F2R, are folded inward onto inner bottom flaps F1U and F1L, as is illustrated in FIG. 38(*d*). As a result, a case, closed at the bottom and open at the top, is made as is shown in FIG. 38(*e*).

3. Finally, adhesive tape, gummed tape, staples, hot-melt, or other sealing means is applied to the folded outer bottom flaps F2L and F2R, thereby sealing the bottom of the case, as is illustrated in FIG. 38(*f*).

As has been described, a flat folded case is opened, shaped and sealed. Outer bottom flaps F2L and F2R tend to open by themselves immediately after they have been folded inward as is shown in FIG. 38(*d*). Unless these outer bottom flaps are strongly held at the folded position, the case will be deformed. In order to prevent such deformation of the case, both outer bottom flaps F2L and F2R are held together, with their opposing edges abutting on each other, while the sealing means such as adhesive tape is being applied to the abutting edges of flaps F2L and F2R. If the opposing edges of these outer flaps are spaced apart while the sealing means is being applied, the case will not only have a poor appearance, but also be insufficiently strong.

According to JIS (Japanese Industrial Standards), flat, corrugated cardboard cases are classified into A type, B type, and C type. The A type is sub-classified into A-1 to A-5 types; the B type is sub-classified into B-1 to B-6 types; the C type is sub-classified into C-1 to C-3 types. Of the cases of these sub-classes, the A-1 type case is the most popular.

As is illustrated in FIGS. 39 and 40, inner flaps F1 of the A-1 type case have a width f1, and outer flaps F2 thereof have a width f2. Widths f1 and f2 are equal, and are half the width W of the case. Namely, $f1=f2=W/2$. Therefore, when outer flaps F2 are folded inward onto inner flaps F1 already folded inwardly, their opposing edges abut on each other, and extend along the center line of the case. When sealing means, such as adhesive tape, is applied to the abutting edges of outer flaps F2, it also extends straight along the center line of the case. Hence, the bottom of the case is sealed strongly, and the sealed bottom looks tidy. This is the reason why the A-1 type case is used more commonly than any of the other types.

As for the other flat A type cases, i.e., the A-2 to A-5 type cases, the inner flaps F1 and outer flaps F2 have the following relationship with the width W and length L of the cases:

A-2 Type Case: $f1=f2>W/2$

A-3 Type Case: $f1=L/2$, $f2=W/2$

A-4 Type Case: $f1=f2=L/2$

A-5 Type Case: $f1=f2>L/2$

In the case of the A-3 type case, the abutting edges of the outer flaps extend along the center line of the case, as can be understood from FIG. 40. Therefore, the case-assembling machine designed for the A-1 type case can be employed also to assemble the A-3 type case, though the A-3 type case is used in less numbers than the A-1 type case.

The corrugated cardboard cases of the sub-classes of each type are commercially available, which are different in length L, width W, and depth D. The case-assembling machine for the A-1 type case is generally considered to be a standard one, whereas the machines for assembling any other types of cases are regarded as custom-made ones. The A-1 case-assembling machine needs to be versatile enough to make the A-1 cases of various sizes. In addition, the case guiding mechanism, case opening mechanism, flap-holding mechanism and case-sealing mechanism of the A-1 case-assembling machine must be adjusted such that they can open, shape, and seal A-1 type cases of different sizes. Here arises a problem with the conventional case-assembling machines, as will be explained below.

The conventional case-assembling machines, including those for assembling A-1 type cases, have a belt conveyor for transporting flat folded preassembled cases. While each flat folded case is being transported, it is first opened, then shaped, and finally sealed. More specifically, as is shown in FIG. 40, the flat folded case is loaded on the conveyor belt, with its two outer flaps of each pair, facing upward and downward, respectively. Obviously, the flat folded case for a case of a specific type has a width different from that of the flat folded case for a case of another type. Hence, to assemble cases of any other type than those which the machine has been assembling, the case guiding mechanism, the case opening mechanism, the flap-folding mechanism, and the sealing mechanism must be aligned to the center line of the folded cases for the cases of the other type. It usually takes a long time to align these mechanisms with the center line of the folded cases for the other type cases. The operation efficiency of the case-assembling machine is inevitably low. Since the machine repuires a device for aligning these mechanisms with the center line of the flat folded cases for any type case which the machine can assemble, the machine is rather complex, large, and heavy. In other words, if the machine is versatile enough to assemble cases of various types and sizes, it cannot be compact or light.

The method of assembling corrugated cardboard cases by means of the conventional machine described above gives rise to trouble in the process of holding the flaps of the cases. As can be seen from FIGS. 38(*b*) and 38(*c*), either inner flap F1 cannot be folded inward if either or both of the outer flaps F2 have been closed very little. When either inner flap is folded inward, with either or both outer flaps F2 closed, the inner flap F1 abuts on outer flap or flaps F2, and is interposed, as a bridge, between outer flaps F2. This trouble, occurring when either or both outer flaps F2 are closed, is known as "bridging." If inner flap F1 is forcedly folded inward in spite of the bridging, both the inner flap and the outer flaps will be deformed or broken, rendering the cardboard case unusable.

Therefore, a new type of a case-assembling machine has been invented which has a sensor for detecting such bridging. As soon as the sensor detects a bridging, that is, as soon as the detector detects a stress being applied to either inner flap F1, the flap-folding mechanism of the machine is automatically stopped, to thereby prevent the deformation or rupture of the case. The interruption of the flap-folding process inevitably reduces the efficiency of the case-assembling operation.

Another new type of a case-assembling machine has been developed which also has a sensor for determining whether or not either outer flap F2 is in a closing position to prevent inner flaps F1 from being folded inward, and a flap-folding mechanism first opens up the outer flaps from the closing positions and then folds the inner flaps F1 inward. The flaps cannot be folded fast, and the case-assembling efficiency is rather low. Further, due to the necessary use of the sensor and the flap-folding mechanism, which not only folds flaps but also opens them, the machine as a whole is complex in structure.

SUMMARY OF THE INVENTION

It is therefore an object of the present invention to provide a method of assembling corrugated cardboard cases, wherein no bridgings occur, and the flaps of each case can thus be folded fast and easily, and also to provide a machine for performing this method.

It is another object of this invention to provide a method of assembling corrugated cardboard cases, which is versatile enough to assemble corrugated cardboard cases of different sizes, and also to provide a machine for performing this specific method.

It is a further object of this invention to provide a mechanism for opening flat folded preassembled cases, without causing any bridging.

The case-assembling machine according to the present invention is designed for assembling A-1 type and A-3 type corrugated cardboard cases. Nonetheless, the machine can be used to make A-2 type, A-4 type and A-5 type corrugated cardboard cases as well, only if given minor changes in design.

According to the invention, in order to achieve the first object, each flat cardboard is opened while the cardboard is being transported upward from a stock stage onto a flap-folding stage. More specifically, the upper-inner flap of each cardboard is folded downward to open the cardboard, while the cardboard is being lifted from the stock stage to the flap-folding stage, attracted to and supported by a suction cup. Once the upper-inner flap has been folded downward, it comes into the gap between the outer flaps. Thus, neither outer flap can no longer be closed. Hence, the upper-inner flap causes no bridgings. The lower-inner flap does not cause a bridging, either. The upper-inner flap, which has been folded downward, pushes the left-outer flap. Thus, as the cardboard is lifted higher and higher, both outer flaps are opened simultaneously. The flat preassembled cardboard is therefore gradually opened, forming a hollow cylindrical case.

In the method according to this invention, a lower edge of any flat preassembled cardboard, which is mounted on a stock stage is aligned parallel to reference line Yo, and the center line of one end panel of the cardboard is aligned with reference line Xo of the stock stage. On a flap-folding stage, the case made by opening the cardboard is positioned such that the center line of the end panel is aligned with reference line Xfc of the flap-folding stage. On a sealing stage, the case is positioned such that the center line of the end panel is aligned with reference line Xsc of a sealing stage. Reference line Yo is parallel to the direction in which the cardboard is transported from the stock stage to the flap-folding stage, and further to the sealing stage. Reference lines Xo, Xfc, and Xsc are parallel to one another, intersect the reference line Yo, and are spaced apart from one another for specific distances.

The method according to the invention repuires no adjustment other than placing each flat cardboard on the stock stage, such that one of the end panel have its center line aligned with reference line Xo and its one lower edge aligned parallel to reference line Yo. Once the flat cardboard has been thus placed on the stock stage, it suffices to transport the cardboard, first from the stock stage to the flap-folding stage for the distance between lines Xo and Xfc, and then from the flap-folding stage to the sealing stage for the distance between lines Xfc and Xsc. Then, the flaps of a cardboard case are folded on the flap-folding stage, and the case is sealed on the sealing stage, regardless of its size.

DETAILED DESCRIPTION OF THE PREFERRED EMBODIMENTS

The embodiments of the present invention will now be described in detail, with reference to the accompanying drawings.

Case-assembling machine 10 according to the invention, which is designed to make A-1 type cardboard cases, will be briefly described, and then a method according to the invention, of assembling cardboard cases will be described.

Figure 1:
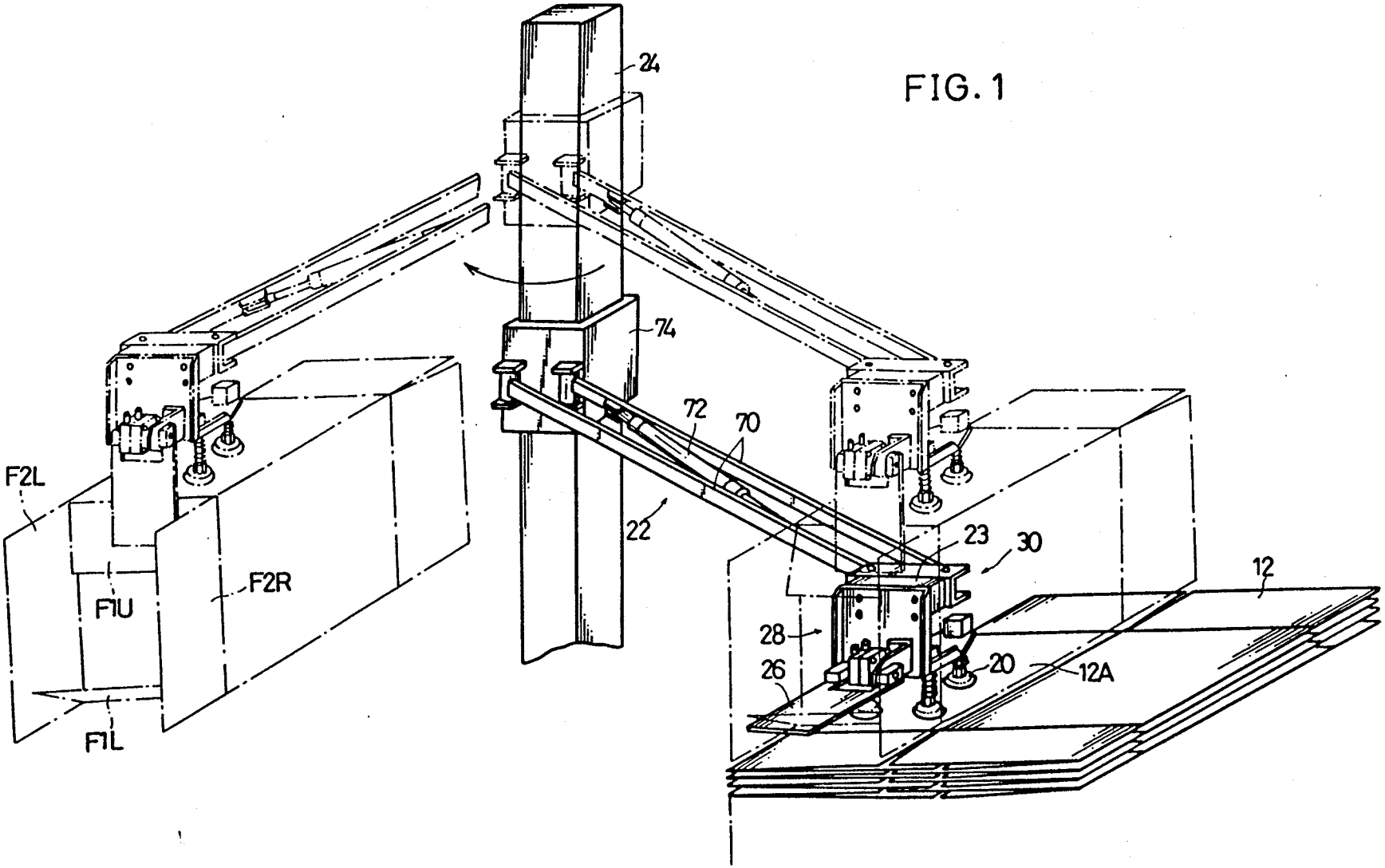
FIG. 1 is a perspective view of a case-assembling machine according to the invention, explaining a method performed by the machine to assemble corrugated cardboard cases.
Figure 2:
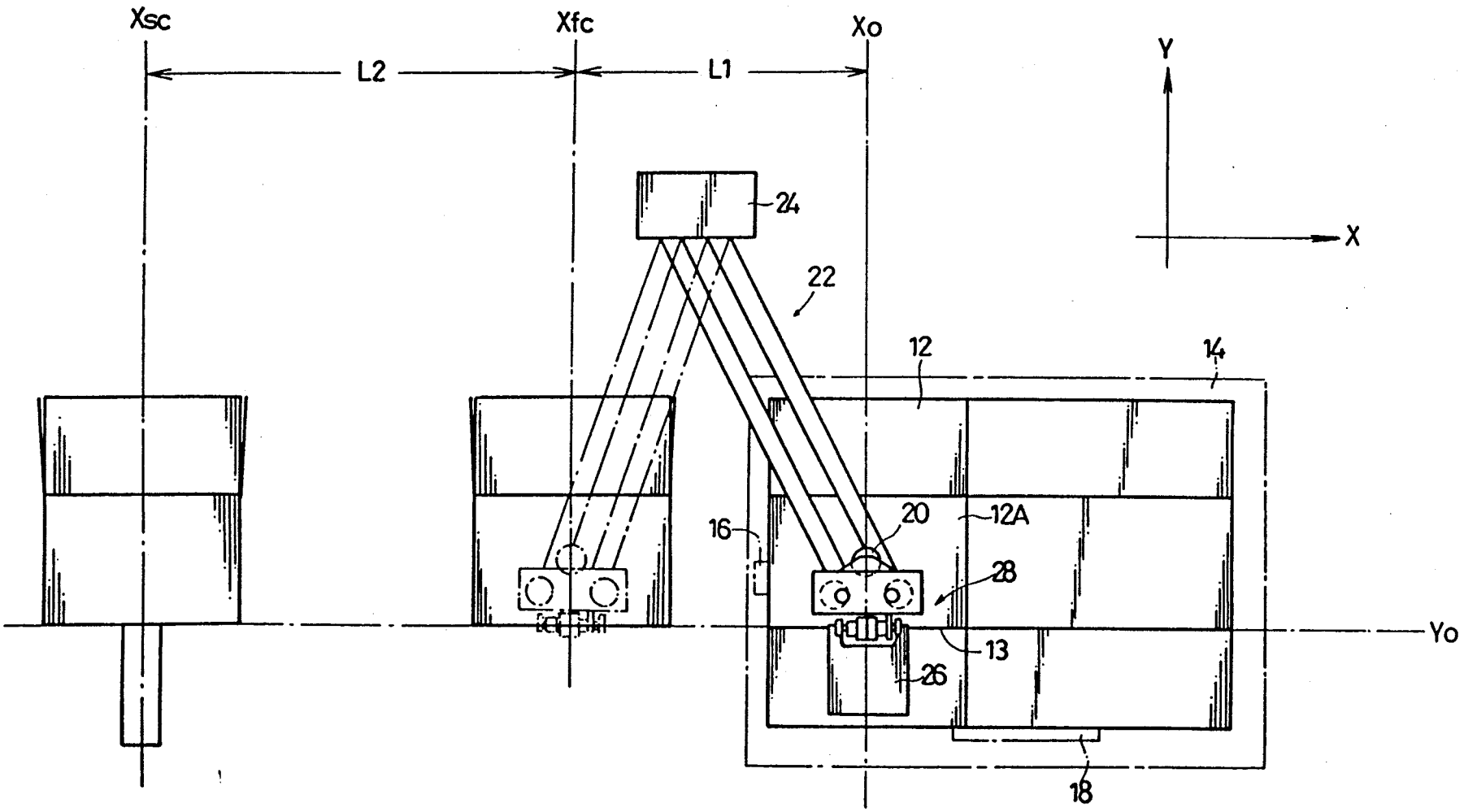
FIG. 2 is a top plan view of the machine, also explaining the method of assembling corrugated cardboard cases.

As is shown in FIGS. 1 and 2, flat folded preassembled cases 12 are stacked on a magazine 14, one upon another. On the magazine 14, each flat-folded case 12 is positioned with respect to both an X-axis direction (i.e., its lengthwise direction) and a Y-axis direction (i.e., its widthwise direction), as will be specifically explained below.

Figure 3:
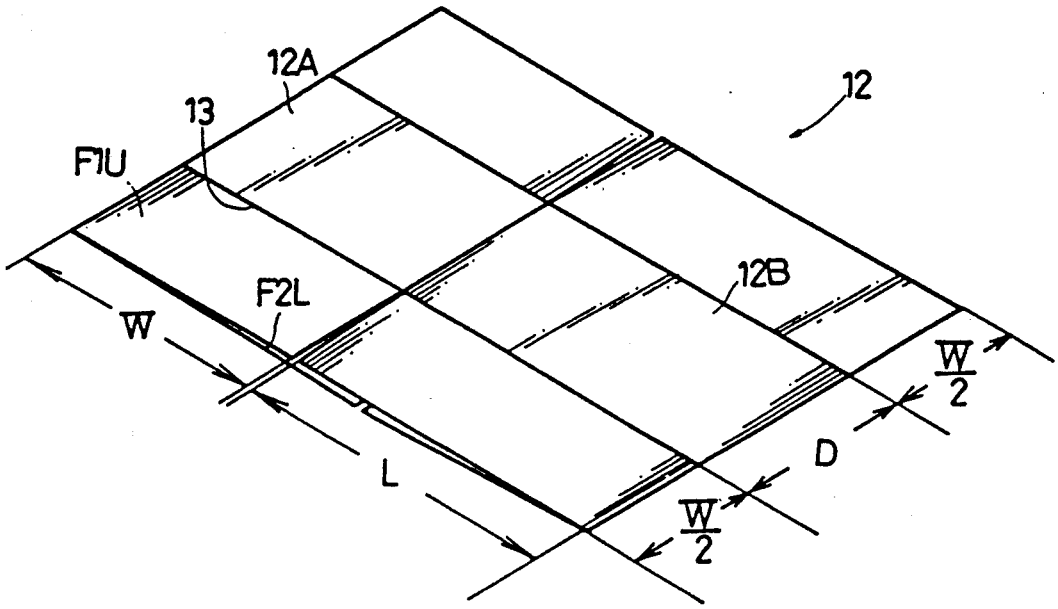
FIG. 3 is a perspective view showing a flat folded preassembled cardboard case.

The magazine 14 has two positioning members 16 and 18. First positioning member 16 can slide in the X-axis direction, whereas second positioning member 16 can slide in the Y-axis direction. Both positioning members 16, 18 are moved to and fixed at desired positions, such that end panel 12A of each flat-folded case 12, which is turned upward, is centered with respect to reference line $X_0$. More precisely, as is shown in FIG. 2, first positioning member 16 is moved leftward from line $X_0$ for distance of W/2, where W is, as can be understood from FIG. 3, the width of the case which is to be assembled from flat-folded case 12. Second positioning member 18 is moved forward from reference line $Y_0$ for distance of W/2 which is equal to the width of the inner flaps of flat-folded case 12. It should be noted that side panel of flat-folded case 12, which is turned upward, is denoted by "12B" in FIG. 3. In short, member 16 is moved leftward from reference line $X_0$ through distance W/2, and member 18 is moved forward from the reference line $Y_0$ for the distance equal to the width of the inner flaps, thus placing flat-folded case 12 at a desired position. All flat-folded cases 12 stacked on magazine 14 are thus properly positioned by means of positioning members 16 and 18. As will be clear later, the method according to the invention requires no adjustment other than moving members 16 and 18, in order to assemble cardboard cases of different sizes.

As shown in FIG. 1, case-opening mechanism 28 having suction cups 20 is located above magazine 14.

The mechanism 28 is lowered until suction cups 20 are pressed onto end panel 12A of flat-folded preassembled case 12. Due to the partial vacuum created in suction cups 20, flat-folded case 12 is attracted to suction cups 20. Then case-opening mechanism 28 is lifted and moved to a flap-folding station, thus transporting case 12 from magazine 14 to the flap-folding station.

Suction cups 20 are attached to the lower surface of support block 23 which in turn is secured to the distal end of rotatable arm 22. The proximal end of arm 22 is connected to slider 74 slidably mounted on post 24. Flat-folding member 26 is rotatably coupled to support block 23. Suction cups 20, support block 23, and flap-folding member 26 constitute case opening mechanism 28.

Rotatable arm 22 is lowered to the position shown by solid lines (FIG. 1), and suction cups 20 hold the uppermost flat-folded case 12 of the stack mounted on magazine 14. Arm 22 is then lifted to the position shown by one-dot chain line (FIG. 1). Arm 22 is rotated, for example, in the clockwise direction, thereby transporting flat-folded case 12 to the flap-folding stage.

While rotatable arm 22 is being lifted, thus moving flat folded case 12 upward from magazine 14, case 12 is opened, thus forming a hollow cylindrical case. More specifically, as arm 22 moves up, flap-folding member 26 is rotated downward, thus folding the upper-inner flap Flu downward. As a result, flat folded case 12 is forcedly opened, as in illustrated in FIG. 1.

Figure 4:
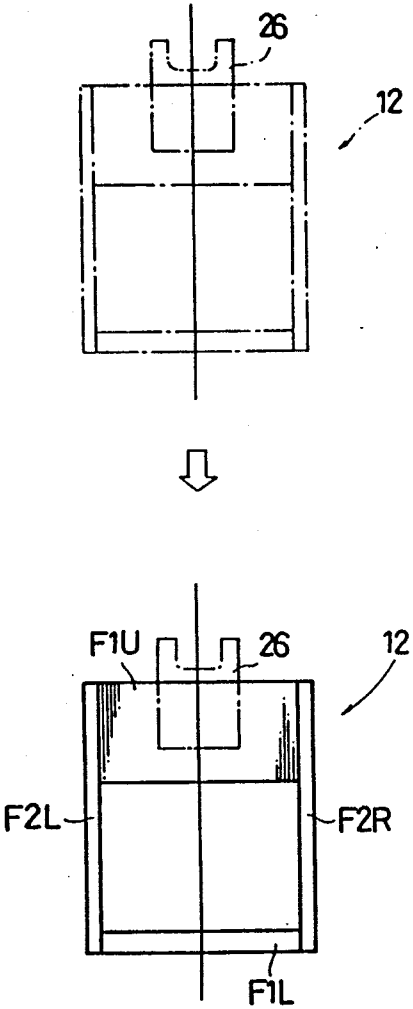
FIG. 4 is a front view showing a cardboard case mounted on the flap-folding station of the case-assembling machine.

As is evident from FIG. 2, the reference line $X_0$ of magazine 14 is set apart from the reference line Xfc of the flap-folding stage by distance L1 in the X-axis direction. Arm 22 is rotated until preassembled flat-folded case 12 moves through distance L1 so that the center line of end panel 12A is aligned with reference line Xfc. When end panel 12A is thus aligned with line Xfc, arm 22 is lowered until the opened case 12 is placed on the flap-folding station, as is shown in FIG. 2 and FIG. 4.

Figure 5:
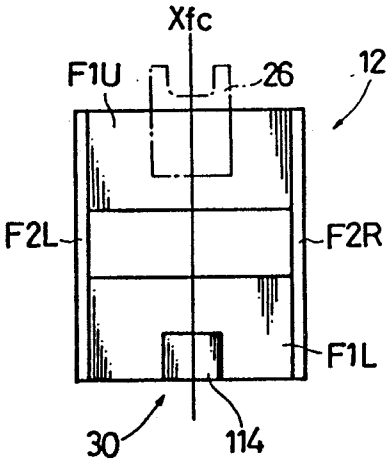
FIG. 5 is a front view illustrating the cardboard case with its lower-inner flap already folded.
Figure 6:
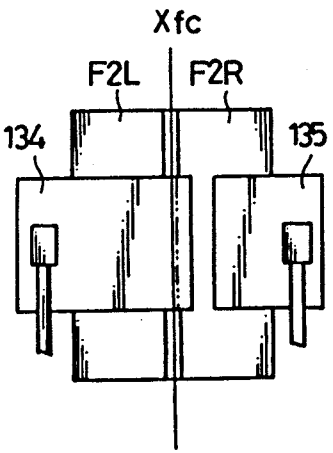
FIG. 6 is a front view showing the cardboard case with both of its outer flaps already folded.

At the flap-folding station, flap-folding mechanism 30 (described later), which has three folding members 114, 134 and 135, folds lower-inner flap F1L inward, and also both outer flaps, i.e., left flap F2L and right flap F2R, inward. More precisely, after the opened case 12 has been positioned, with its end panel 12A aligned with reference line Xfc, flap-folding member 114 of mechanism 30 is rotated upward, thereby folding lower-inner flap F1L, as is shown in FIG. 5. Then, left folding member 134 and the right folding member 135 of mechanism 30 are rotated, thus folding left-outer flap F2L and right-outer flap F2R inward, respectively, as is illustrated in FIG. 6. As soon as folding member 114 folds lower-inner flap F1L, it is rotated downward to its initial position, so as not to prevent folding members 134 and 135 from rotating to fold outer flaps F2L and F2R.

As has been described, flat-folded preassembled case 12 is opened as upper-inner flap F1U is folded downward while the flat-folded case 12 is being lifted. When flate-folded case 12 is opened in this way, flap F1U pushes both outer flaps F2L and F2R aside as is shown in FIG. 4. Once upper-inner flap F1U has folded completely, thus taking a vertical position, both outer flaps F2L and F2R are fully opened and not in such positions as to prevent lower-inner flap F1L from being folded upward. Lower-inner flap F1L is therefore is easily and quickly folded upward by means of flap-folding member 114.

As is evident from FIG. 2, the reference line Xfc of the flap-folding station and the reference line Xsc of the case-sealing station are spaced apart by a predetermined distance L2 in the X-axis direction. Therefore, when case 12 is moved from the flap-folding stage for this distance L2 in the X-axis direction, it will be automatically aligned with the reference line Xsc and placed at the case-sealing station.

While case 12 is being transported from the flap-folding station to the case-sealing station, the folding members 134 and 135 of mechanism 30 remain in their flap-folding positions. Hence, case 12 is not deformed. Before these members 134 and 135 leave case 12, both outer flaps F2L and F2R are moved onto guide 154, as may be understood from FIG. 7. Thereafter, guide 154 keeps both outer flaps in folded position, whereby case 12 is not deformed.

Figure 8:
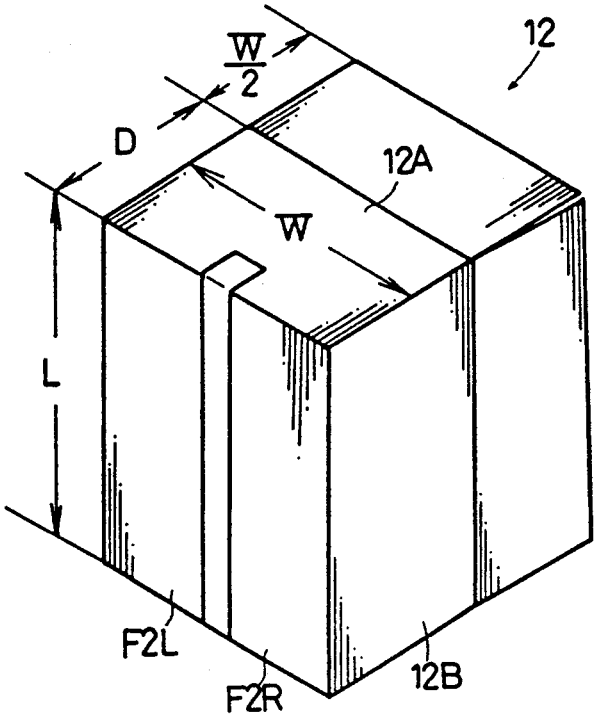
FIG. 8 is a perspective view showing the cardboard case assembled by the machine.
Figure 7:
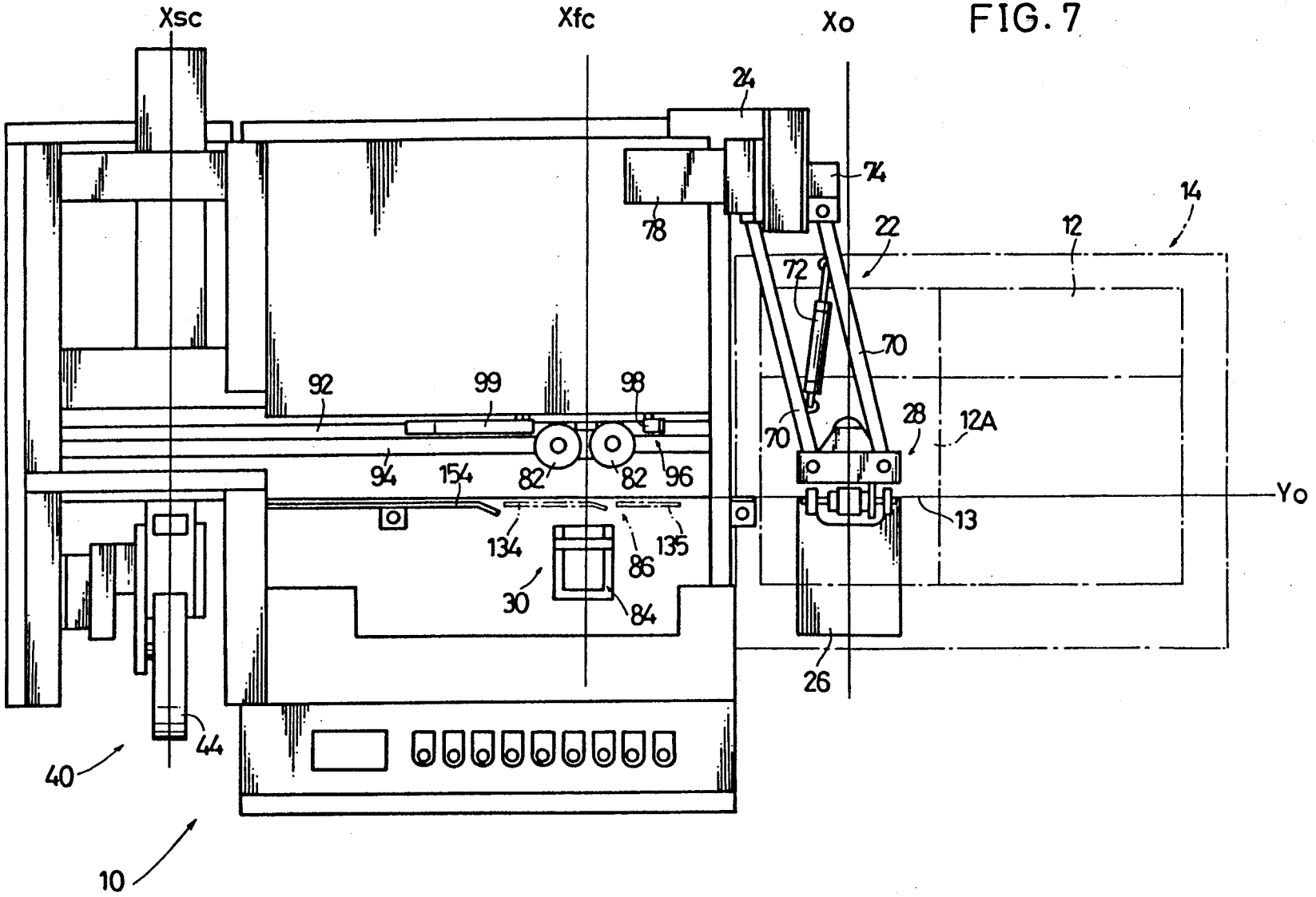
FIG. 7 is a top plan view showing the machine in more detail than FIG. 2.

After case 12 has been moved for distance L2 from the flap-folding station, it is sealed by means of case-sealing mechanism 40, which is of the well-known type, such as the one manufactured by SIAT, Inc., Italy. As is shown in FIG. 7, for example, case-sealing mechanism 40 comprises tape reel 44 holding a roll of adhesive tape. When case 12 is aligned with the reference line Xsc of the case-sealing station, tape reel 44 is moved up until the roll of adhesive tape contacts the bottom of case 12. The adhesive tape is applied to the abutting edges of the outer flaps, thus sealing the bottom of case 12. As a result, the case 12 shown in FIG. 8 is assembled.

As has been described, the reference line $X_0$ of magazine 14 and the reference line Xfc of the flap-folding station are set apart by a distance L1, and the reference line Xfc and the reference line Xsc of the case-sealing station are set apart by a distance L2. Further, the lower edge 13 of flat-folded case 12 is aligned with the reference line $Y_0$ when flat-folded case 12 is placed on the magazine 14 and also when the case 12 is mounted on the flap-folding station. Therefore, when case 12 is transported from magazine 14 for distance L1, it is automatically aligned with the reference line Xfc. While case 12 remains in alignment with the reference line Xfc, lower-inner flap F1U and both outer flaps F2L and F2R are folded. Hence, flap-folding mechanism 30 need not be adjusted in order to fold the lower-inner flap and two outer flaps of a case of a different size.

Moreover, when case 12 is transported from the flap-folding station for distance L2, it is automatically aligned with the reference line Xsc of the case-sealing station. While case 12 remains in alignment with the reference line Xsc, case-sealing mechanism 40 can apply sealing means such as adhesive tape to the abutting edges of outer flaps F2L and F2R. Hence, case-sealing mechanism 40 need not be adjusted in order to seal the bottom of a carboard case of a different size.

As may be understood from the above, the case-assembling machine 10 according to the invention can shape and seal carboard cases of different sizes, provided that positioning members 16 and 18 are moved in the X-axis direction and the Y-axis direction, respectively, thereby to move each flat folded case 12 to the desired position on magazine 14. Machine 10, therefore, can assemble cases of different sizes, and is thus versatile. In addition, since machine 10 requires no means for adjusting flap-folding mechanism 30 or case-sealing mechanism 40, the case-assembling machine 10 is compact and light.

Case-assembling machine 10, which comprises case-openings mechanism 28, flap-folding mechanism 30, and case-sealing mechanism 40, will be described in greater detail.

Figure 9:
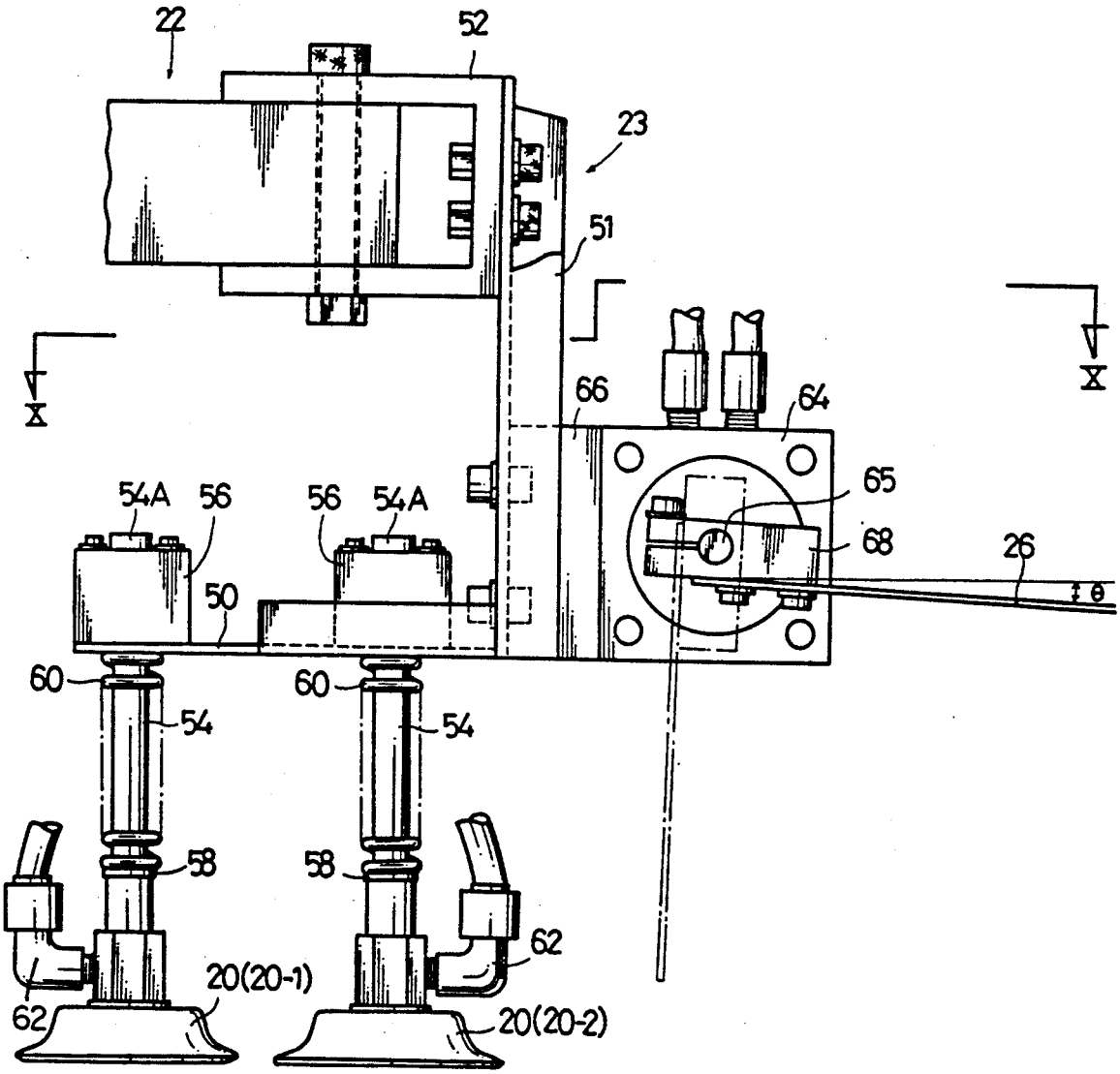
FIG. 9 is a side view showing the case-opening mechanism incorporated in the machine.
Figure 10:
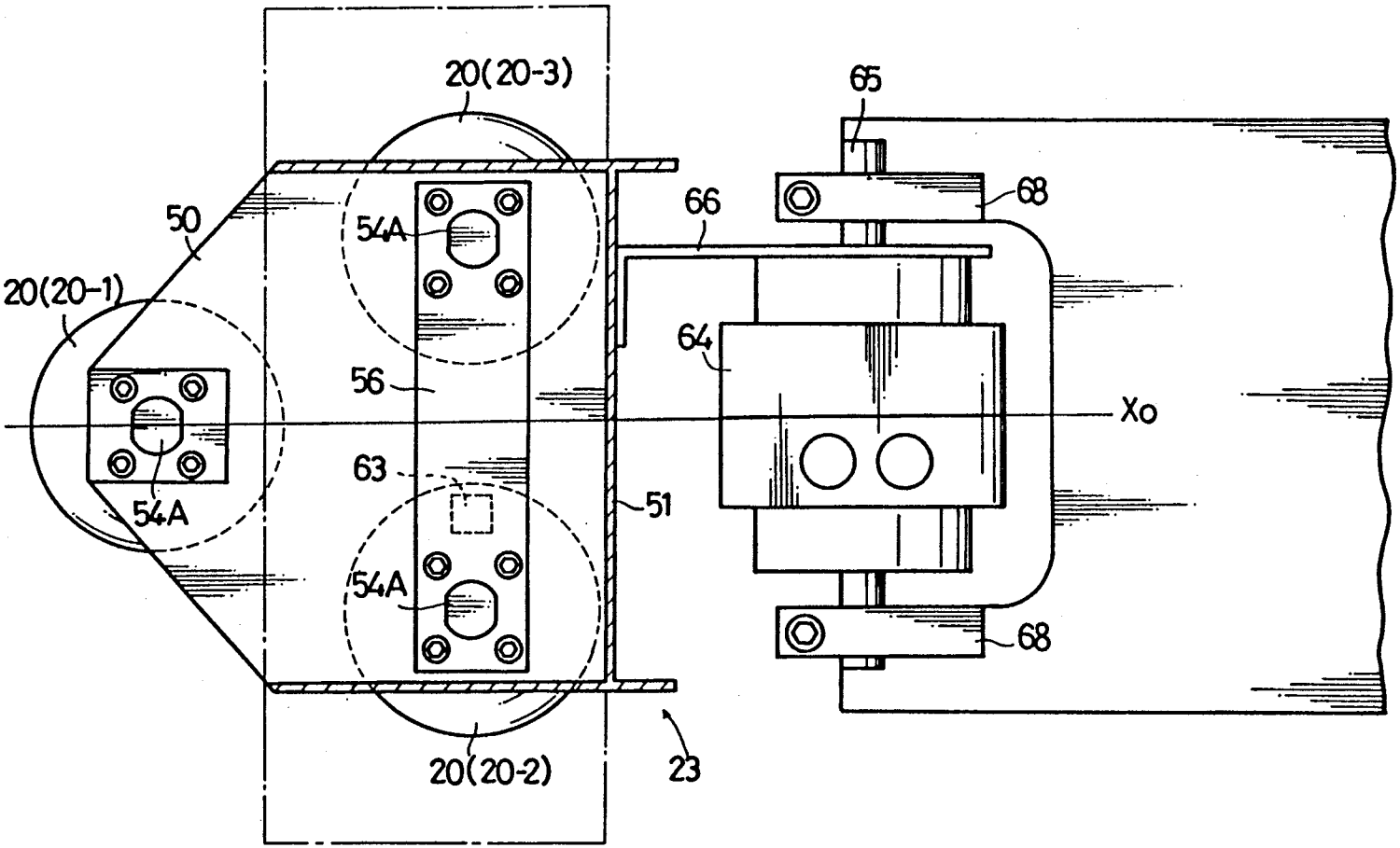
FIG. 10 is a top plan view taken along line X—X in FIG. 9.

As is shown is FIGS. 1 and 7, case-opening mechanism 28 comprises suction cups 20 and flap-folding member 26. As has been explained, suction cups 20 and flap-folding member 26 are attached to support block 23, and support block 23 is secured to the distal end of rotatable arm 22. The proximal end of arm 22 is connected to slider 74 slidably mounted on post 24. As is shown in FIGS. 9 and 10, support block 23 comprises base plate 50, vertical member 51 having an H-shaped cross section, and pivotal member 52 fastened to the upper end of vertical member 51 by bolts and having a U-shaped cross section.

Three suction cups 20-1 to 20-3 are located below base plate 50 and connected to thereto by means of shafts 54. The first cup 20-1 is aligned with reference line $X_0$ of magazine 14, whereas the remaining cups 20-2 and 20-3 are arranged symmetrically to each other with respect to reference line $X_0$. Shaft 54 of each suction cup 20 passes through base plate 50 and is pivotally supported by support 56 mounted on base plate 50. The upper end 54A of each shaft 54 has a diameter larger than the other portion, so that shaft 54 does not slip down out of support 56. Washer 58 is mounted on the intermediate portion of each shaft 54, and compression spring, such as compression coil spring 60 is wound around shaft 54 and located between washer 58 and the lower surface of base plate 50. Conduit 62 is connected, at one end, to each suction cup 20 which is attached to the lower end of shaft 54. Conduit 62 is connected, at the other end to a vacuum pump (not shown). When the vacuum pump is operated, each suction cup 20 is evacuated, thus creating a partial vacuum within it and attracting a flat-preassembled case 12 to it. Proximity switch 63, functioning as a sensor for controlling the speed at which suction cups 20-1 to 20-3 are moved vertically, is attached to support 56 and located close to shaft 54 connecting suction cup 20-2 to support 56.

The embodiment has three suction cups 20-1 to 20-3 which are arranged at the vertices of a triangle. Nonetheless, one or two suction cups suffice. When only one suction cup is used, it is aligned on the reference line $X_0$ of magazine 14. When two suction cups are used, they are either juxtaposed on the reference line $X_0$ or arranged symmetrically with respect to the line $X_0$.

Flap-folding member 26 is a plate. It can be replaced with a claw. As is shown in FIG. 9, flap-folding member 26 is fixed to support block 23. While a flat-folded case 12 attracted to suction cups 20 is being lifted, flap-folding member 26 is rotated downward, thus folding upper-inner flap F1U of case 12. Pneumatic 90°-actuator 64 is fastened to vertical member 51 by bracket 66. This actuator 64 has a shaft 65, to which member 26 is attached by fastener 68 having a slit. Flap-folding member 26 has a notch in its upper end portion, and 90°-actuator 64 is placed in this notch. Pneumatic 90°-actuator 64 is designed such that its shaft 65 is rotated through 90° when compressed air is supplied to actuator 64. When shaft 65 is rotated by 90°, flap-folding member 26, which is connected to shaft 65, is also rotated through 90°. Flap-folding member 26 is attached to shaft 65, inclined downward at a small angle $\theta$. Since member 26 is inclined downward, its distal end can easily enter opening case 12, thereby folding upper-inner flap F1U readily. Angle $\theta$ may be, for example, 5° to 10°.

As is illustrated in FIGS. 1, 7, 11 and 12, arm 22 is comprised of only two parallel bars 70 and cylinder mechanism 72, and is relatively simple in structure. Both bars 70 are pivotally connected, at one end, to pivotal member 52 of the support block 23, and at the other end, to slider 74 slidably mounted on post 24. As is shown in FIG. 7, cylinder mechanism 72, which is pneumatic, comprises a cylinder, a piston slidably inserted in the cylinder, and a rod connected, at its proximal end, to the piston. The distal end of the rod is pivotally connected to the first bar 70, and the proximal end of the cylinder is pivotally coupled to the second bar 70. When compressed air is supplied to cylinder mechanism 72, the piston is moved in one direction or the other within the cylinder, whereby the rod moves inwardly or outwardly. As the rod moves in this way, arm 22 rotates around post 24.

Figure 11:
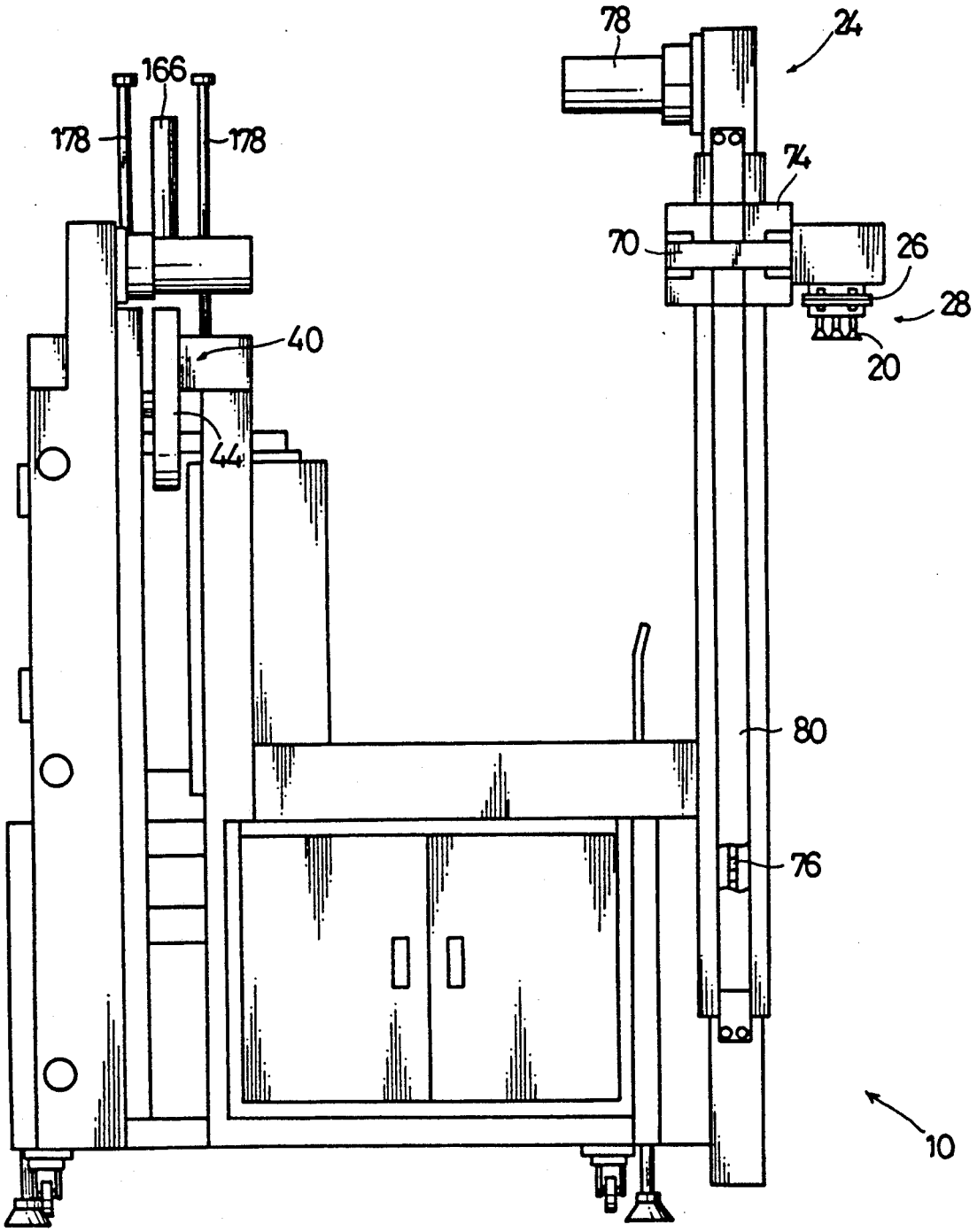
FIG. 11 is a front view schematically showing the case-assembling machine.
Figure 12:
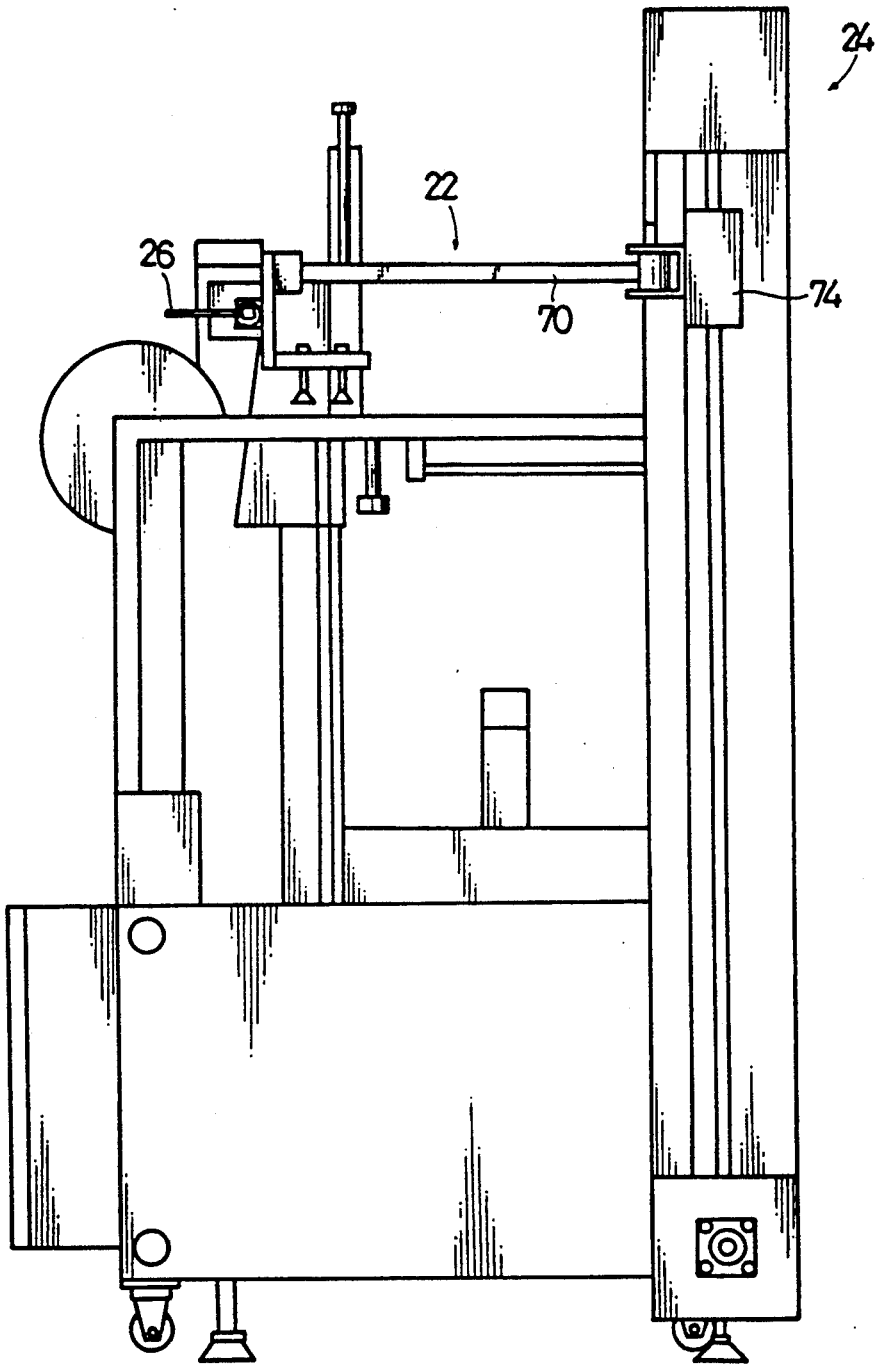
FIG. 12 is a right-side view schematically illustrating the case-assembling machine.

As is shown in FIGS. 11 and 12, endless chain 76 is wrapped around two guide rollers fixed to the upper end of post 24, and a guide roller secured to the lower end of post 24. Hence, endless chain 76 extends vertically and is fastened, at one portion, to slider 74. Endless chain 76 can be driven by motor 78 fastened to the upper end of post 24. Chain 76 is covered and is protected by long, trough-shaped cover 80. When motor 78 drives endless chain 76 in one direction or the other, slider 74 slides up or down on post 24, whereby arm 22 is moved up or down.

It will now be explained how the case-opening mechanism 28 performs its function.

Figure 13:
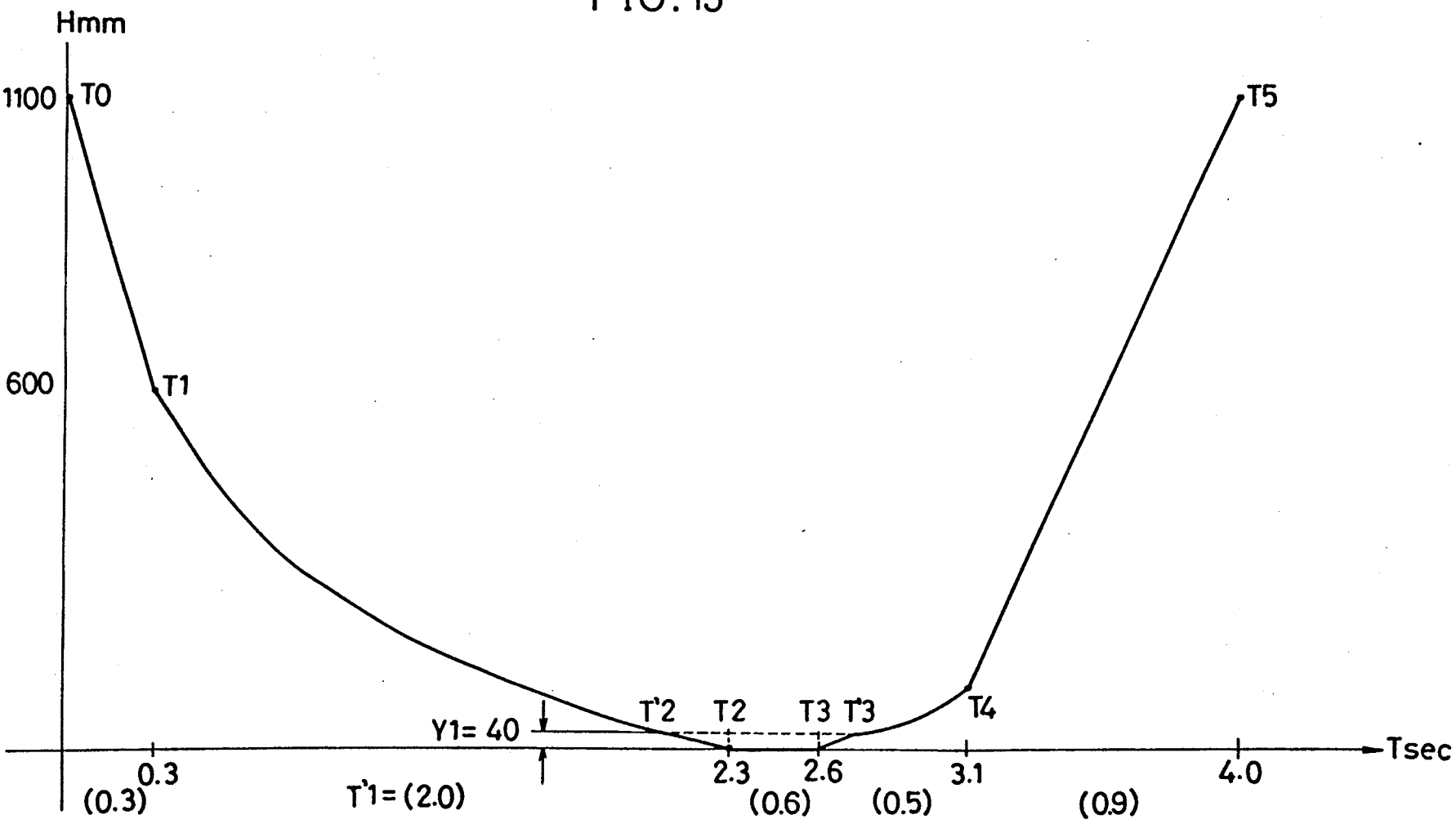
FIG. 13 is a graph showing how the speed changes, at which the rotatable arm of the machine moves up and down.
Figure 14:
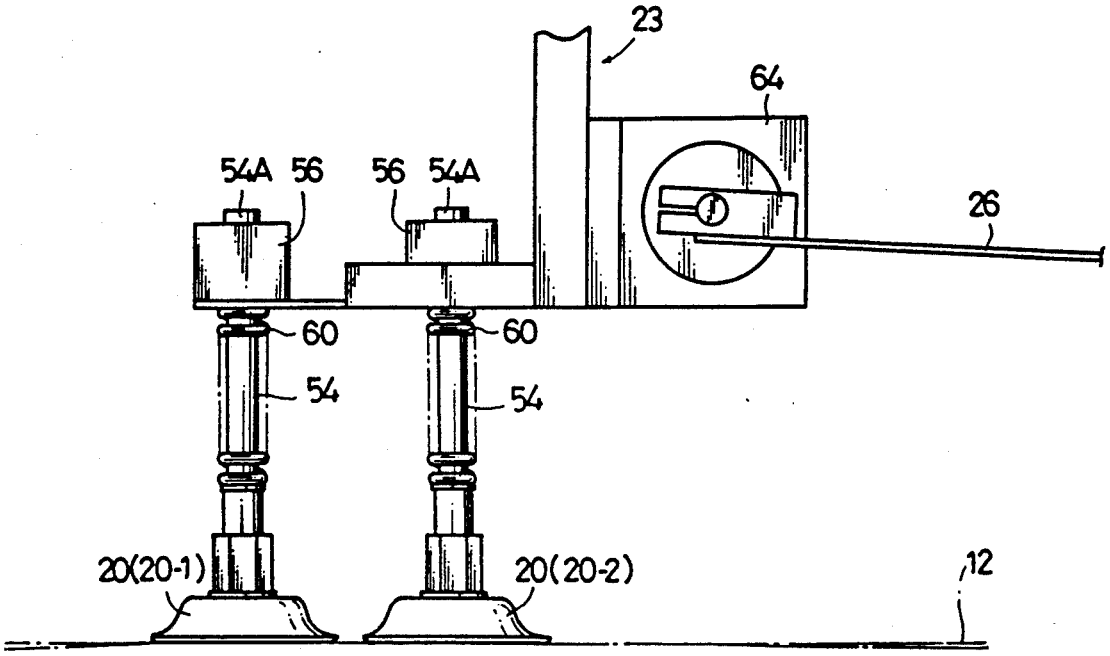
FIGS. 14(A) to 14(B) are side views of the machine, explaining how the case-opening mechanism operates, thus opening a flat folded preassembled case.
Figure 14:
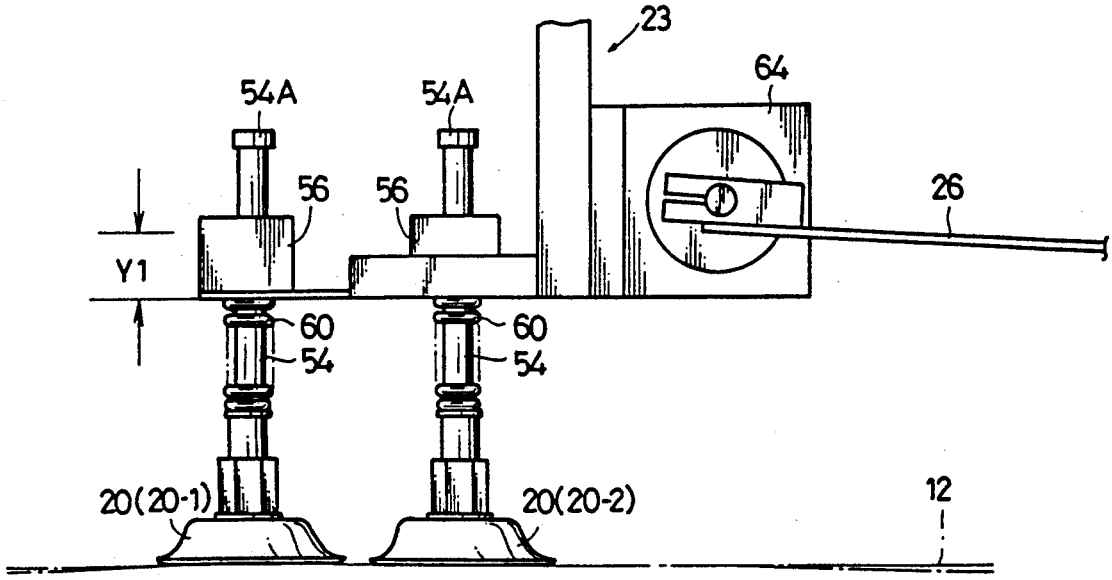
Figure 14:
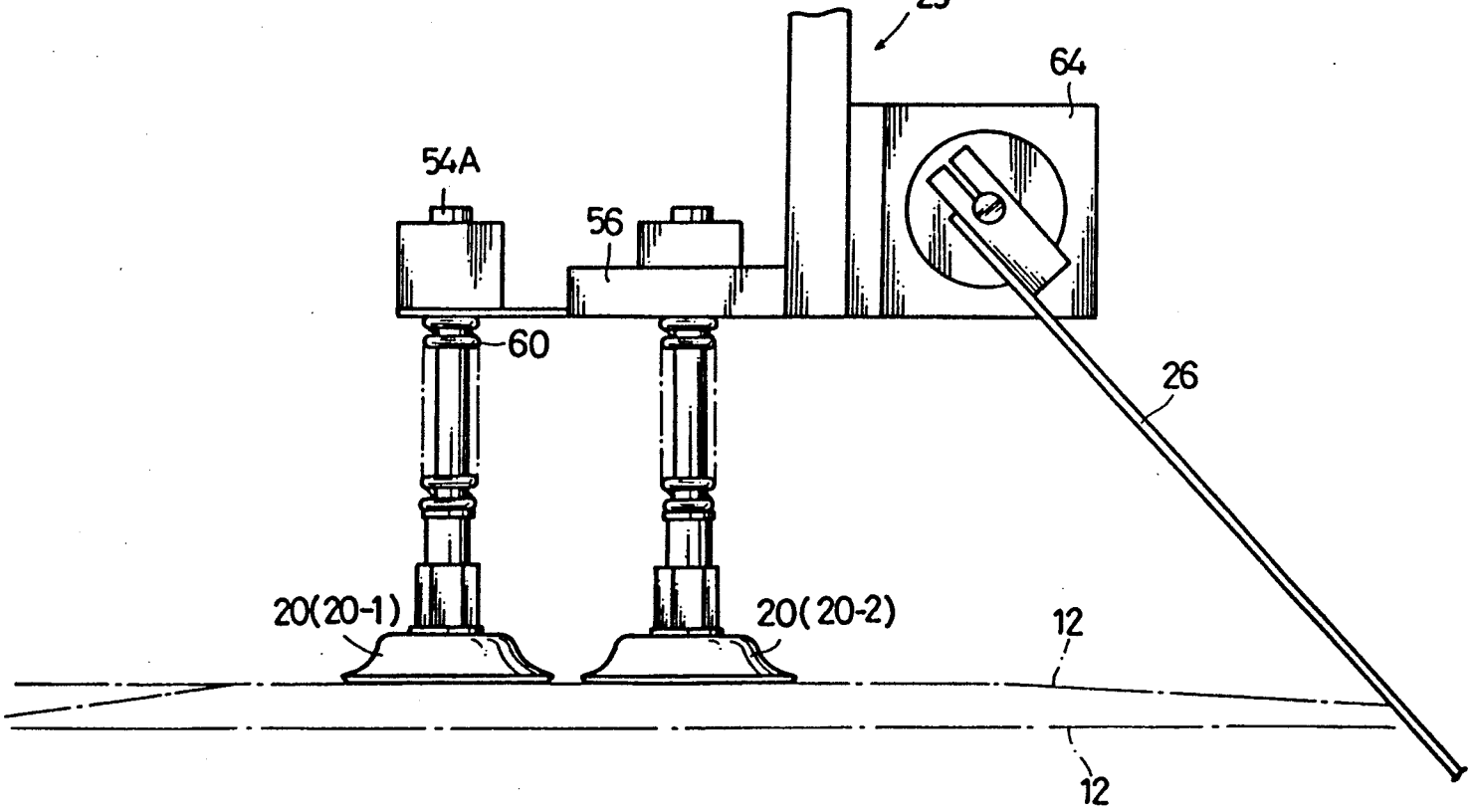
Figure 14:
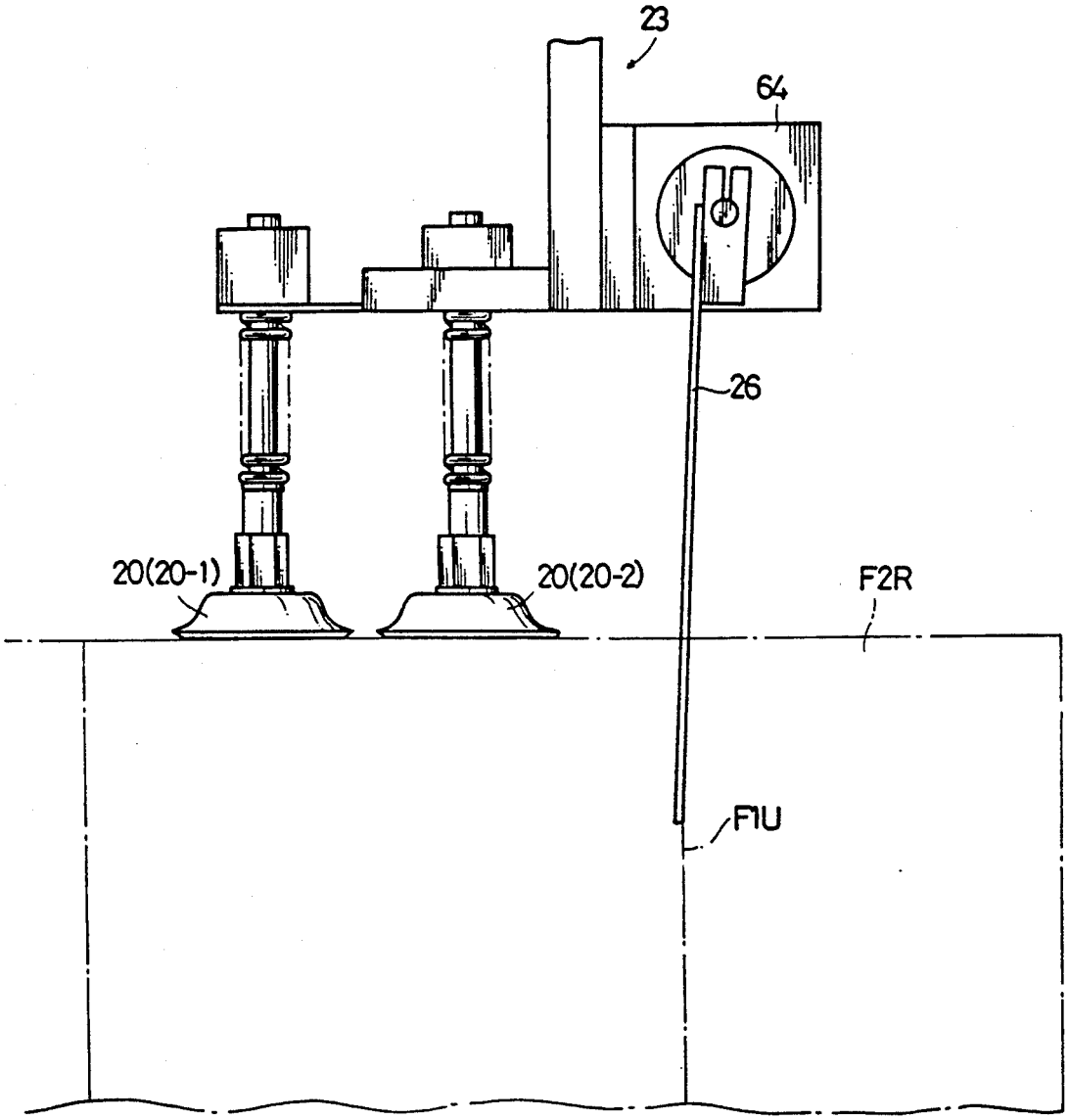

In the initial phase of the operation, suction cups 20 are located above end panel 12A of flat folded case 12. Motor 78 is turned on, thus driving endless chain 76 in the first direction, whereby slider 74 is moved downward, and arm 22 is also moved downward. Hence, suction cups 20 are lowered, and eventually contact end panel 12A of flat-folded case 12. As can be understood from FIG. 13, which shows how the speed changes at which arm 22 is lowered and lifted, suction cups 20 are moved down at high speed, starting at time TO. Immediately thereafter, at time T1, cups 20 are decelerated. Upon lapse of period T1' from time T1, cups 20 abut on end panel 12A of case 12 as shown in FIG. 14(A). As suction cups 20 are further lowered as shown FIG. 14(B), the distal end 54A of each shaft 54 projects upward from the top of support 56. Then, at time T2, proximity switch 63 (FIG. 10) detects that shaft 54 has projected upward from support 56, thus determining that cup 20 has contacted case 12. The brakes are at once applied on slider 74 at time T2'. Nonetheless, slider 74 further moves down, along with arm 22, for distance Y1, while compressing springs 60 wound around shafts 54. Springs 60, thus compressed and shortened by about 40 mm, attain a biasing force and push suction cups 20 onto case 12. Hence, cups 20 are strongly pressed onto the end panel 12A of case 12, as is shown in FIG. 14(B). Arm 22 completely stops at time T2. Then, the vacuum pump is turned on, thereby pumping air out of suction cups 20 via conduits 62. A partial vacuum is thereby created within each cup 20, and suction cups 20 attract case 12 12 readily and reliably. This is because no vacuum leaks from cups 20 since all cups 20 are strongly pressed onto case 12 due to the biasing force of springs 60 which are now compressed.

Thereafter, at time T3, slider 74 is released from the brake, and starts moving upward as it is driven by endless chain 76. Hence, arm 22 is lifted. Suction cups 20 do not moved up at once since compression springs 60, which are compressed, are shorter than their original length by distance Y1. Thus, cups 20 start moving up at time T3' when arm 22 has been lifted for distance Y1. As arm 22 is further lifted, suction cups 20 are also lifted.

Shortly before suction cups 20 start moving upward, 90°-actuator 64 is operated, thereby rotating flap-folding member 26 downward. Hence, flap-folding member 26 starts folding the upper-inner flap F1U of case 12 at time T3' when cups 20 begin to move up along with arm 22.

With reference to FIGS. 15(A) to 15(D), it will be explained how flap-folding member 26 folds upper-inner flap F1U.

Figure 15:
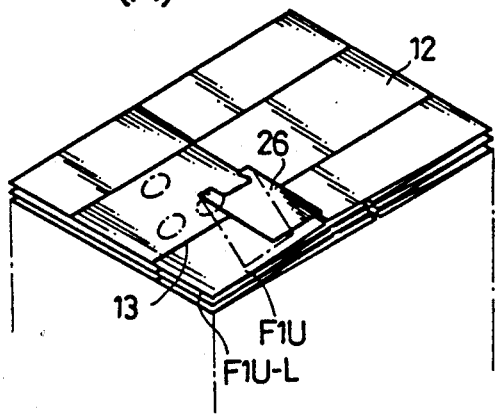
FIGS. 15(A) to 15(E) are perspective views of a stack of flat folded cases, explaining how the case-opening mechanism opens the uppermost folded case.
Figure 15:
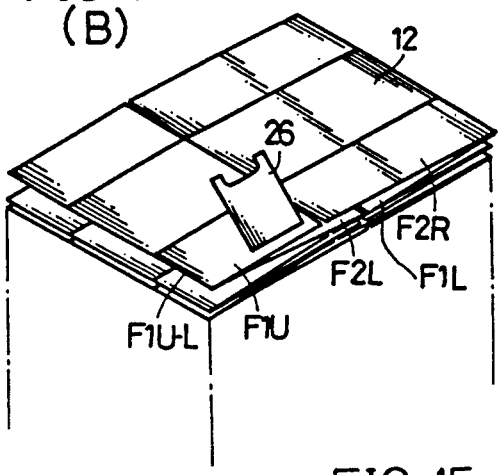
Figure 15:
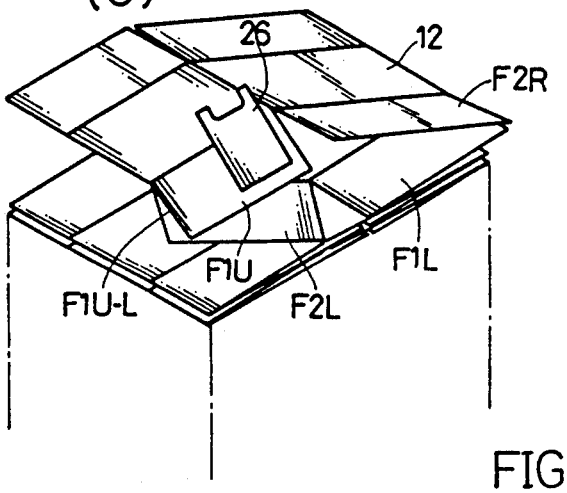
Figure 15:
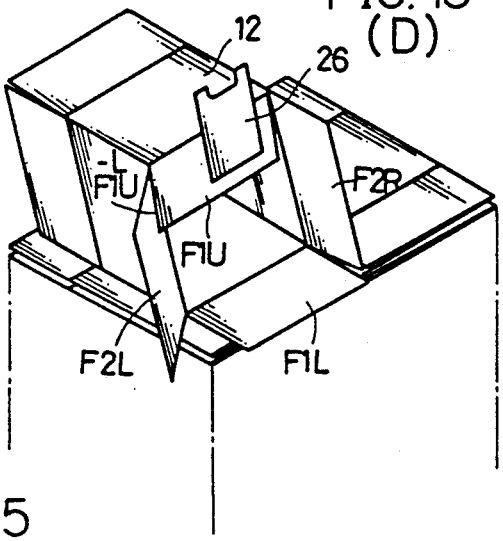
Figure 15:
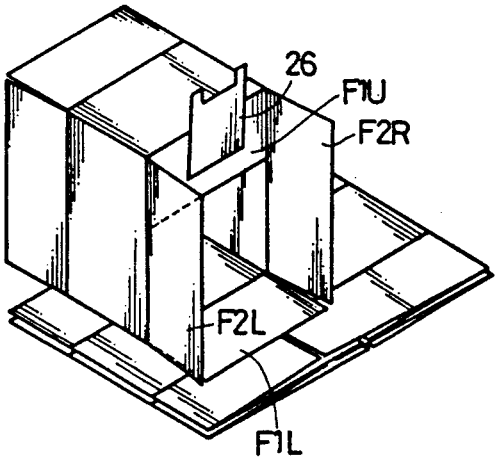

As is indicated by the one-dot chain line shown in FIG. 15(A), flap-folding member 26 presses upper-inner flap F1U before cups 20 are lifted. As a result, the left edge F1U-L of flap F1U pushes left-outer flap F2L. As suction cups 20 move upward, thus lifting case 12, the left edge F1U-L of flap F1U further pushes left outer flap F2L, whereby case 12 is gradually opened and held up, as is illustrated in FIGS. 15(B) to 15(D). Along with left outer flap F2L, right outer flap F2R is held up as case 12 is lifted further. Case 12 is eventually opened completely at time T4 as is shown in FIG. 15(E). While case 12 is being opened, rotatable arm 22 is moved up at low speed. When case 12 is fully opened at time T4, it turns off the brake on slider 74, whereby arm 22 is lifted at high speed. Rotatable arm 22 moves up at high speed until it reaches a prescribed position at time T5. Cardboard case 12, thus fully opened and elevated, is shown by the one-dot chain line in FIG. 1.

Then, the piston of cylinder mechanism 72 is pushed outward, whereby arm 22 is rotated in the clockwise direction as is shown in FIG. 1. Cardboard case 12 is therefore transported to a position right above the flap-folding station. When cardboard case 12 reaches this position, slider 74 is lowered to a prescribed position. As a result of this, case 12 is placed on the flap-folding station, as is illustrated in FIGS. 2 and 4.

Since upper-inner flap F1U is folded downward at the same time case 12 is lifted, it forthwith pushes open left-outer flaps F2L at once. Hence, as can be clearly seen from FIG. 4, neither left outer flap F2L nor right outer flap F2R can remain in a closed position to prevent lower-inner flap F1L from being folded upward. Therefore, no sensor is required to detect whether or not either outer flap remains in such a closed position. Nor is a mechanism is required which forcedly pushed open both outer flaps to facilitate the folding of lower-inner flap F1L. Case-assembling machine 10 according to this invention is therefore simple, compact, and light.

Since compressed springs 60 require some time to restore their shape, suction cups 20 start moving upward, not at the moment rotatable arm 22 begins to move up, but at a little later time. After arm 22 has begun to rise, springs 60 gradually expand, thus reducing the force applied on suction cups 20. Spring 60, which have been compressed, therefore expand little by little as arm 22 is moved up. Hence, an upward pulling force is applied to case 12 increasingly, and case 12 is lifted in this way, the gap between it and the next case broadens or increases gradually, allowing air to flow into this gap in an increasing amount. The uppermost case 12 can therefore be smoothly released from the stack of cases, and the next case is never lifted together with the uppermost one.

As has been explained, because of the use of compression springs 60, a time-lag is provided between the start of the lifting of arm 22 and the lifting of case 12. Due to this time-lag, flat folded cases 12 are lifted from magazine 14, one by one without fail. Therefore, the stack of cases is not distorted, and the case-assembling process is not interrupted, as might happen in the case where two or more flat cardboards 12 are lifted together from magazine 14. This ensures a high case-assembling efficiency.

Rotatable arm 22 is rotated from magazine 14 to the flap-folding stage through such a predetermined angle that not only the end panel 12A of any cardboard case 12 placed on the flap-folding station is aligned with the reference line Xfc of the flap-folding station, but also the lower edge 13 of end panel 12A is aligned with the reference line $Y_0$.

While arm 22 is rotating from magazine 14 to the flap-folding station, a rotation moment is exerted on suction cups 20 since cups 20 hold cardboard case 12. Since case-assembling machine 10 according to the invention has three suction cups 20, and case 12 is held at three points, case 12 is not rotated at all with respect to arm 22. Hence, case 12 is place at the desired position on the flap-folding station. One suction cup suffices, provided this cup has a diameter large enough not to rotate cardboard case 12.

Figure 16:
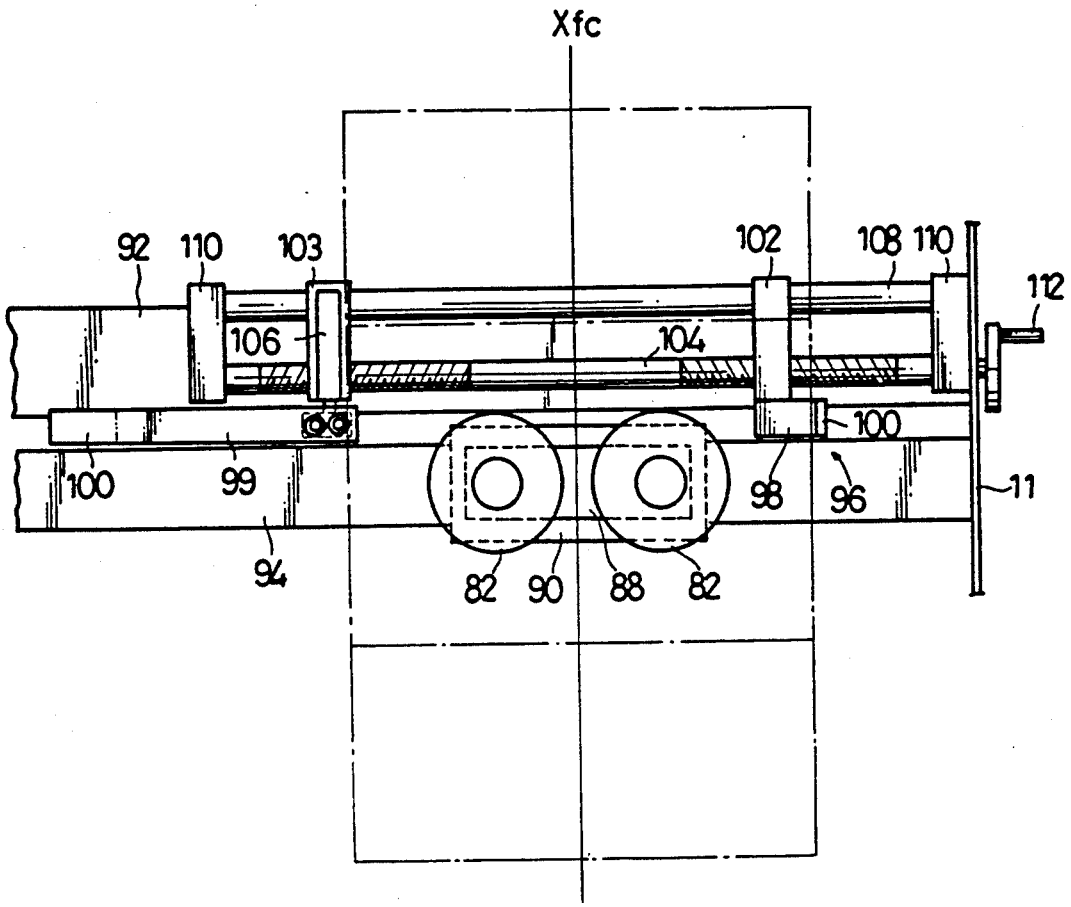
FIG. 16 is a top plan view showing the suction cups and the vibration-damping mechanism, both mounted at the flap-folding station of the case-assembling machine.

Flap-folding mechanism 30 is located at the flap-folding station. As is shown in FIG. 16, this mechanism 30 comprises two suction cups 82, inner-flap folder 84, and outer-flap folder 86. Suction cups 82 are of the same type as suction cups 20 of case opening mechanism 28, and are designed to hold cardboard case 12 transported from the flap-folding station to the case-sealing station. When suction cups 82 contact onto the lower end panel 12A of cardboard case 12, a vacuum pump (not shown) connected to cups 82 are driven, thus creating a partial vacuum within both cups 82. As a result, suction cups 82 attract cardboard case 12 and hold cardboard case 12 in place. Cups 82 continue to hold cardboard case 12 until cardboard case 12 is transported from the flap-folding station to the case-sealing station and is sealed by means of case-sealing mechanism 40.

As is shown in FIG. 16 and FIGS. 17(A) and 17(B), support 88 supporting both suction cups 82 is secured to box-shaped slider 90. Slider 90 is coupled to rod-less cylinder mechanism 92 and slidably mounted on guide 94. Flap-folding mechanism 30 further comprises stopper mechanism 96 for preventing cardboard case 12 from rotating and accurately positioning the same on the flap-folding station. It should be noted that stopper mechanism 96 can be dispensed with. Stopper mechanism 96 comprises right guide 98 and left guide 99. Either guide is made of a thin steel plate, the upper end portion of which is bent outward to guide cardboard case 12 downward, smoothly into contact with suction cups 82. Guides 98 and 99 are connected to sliders 102 and 103, respectively. Sliders 102 and 103 are mounted on a drive shaft 104, two half portions of which are threaded in the opposite directions.

Left guide 99 is located in the path in which cardboard case 12 is transported from the flap-folding station to the case-sealing station. In order not to hinder the transport of case 12, left guide 99 can rotate, whereas right guide 98 cannot rotate and always extends vertically. More specifically, guide 99 is connected to the shaft of 90°-actuator 106, so that actuator 106 can rotate left guide 99, thus moving guide 99 out of the path of cardboard case 12. Sliders 102 and 103 are coupled drive shafts 104 in such a manner that both guides 98 and 99 are positioned symmetrically with respect to reference line Xfc of the flap-folding station.

As is illustrated in FIG. 16, flap-folding mechanism 30 further comprises guide shaft 108 extending parallel to drive shaft 104, and bracket 110 supporting both drive shaft 104 and guide shaft 108. Bracket 110 is fastened to frame 11 of case-assembling machine 10.

The positions of guides 98 and 99 are adjusted, before use, to the width W of cardboard case 12. That is, handle 112 attached to drive shaft 104 is rotated, thereby moving guides 98 and 99 in the opposite directions, either toward each other or away from each other, thus changing the gap between them to a value a few millimeters greater than the width W of cardboard case 12. It is desirable that drive shaft 104 be automatically rotated as the second positioning member 18 of magazine 14 is adjusted in the X-axis direction. If this is the case, the positions of guides 98 and 99 are automatically adjusted, without rotating handle 112.

Before case 12 is transported from magazine 14 to the flap-folding station, 90°-actuator 106 for rotating left guide 99 is operated, thus bringing guide 99 into the vertical position. Left guide 99 remains vertical during the flap-folding process. After the flap-folding process, and before the transport of case 12 to the case-sealing station, 90°-actuator 106 is operated, this time rotating guide 99 into a horizontal position. Hence, case 12 can be transported to the case-sealing station unobstructedly.

Figure 18:
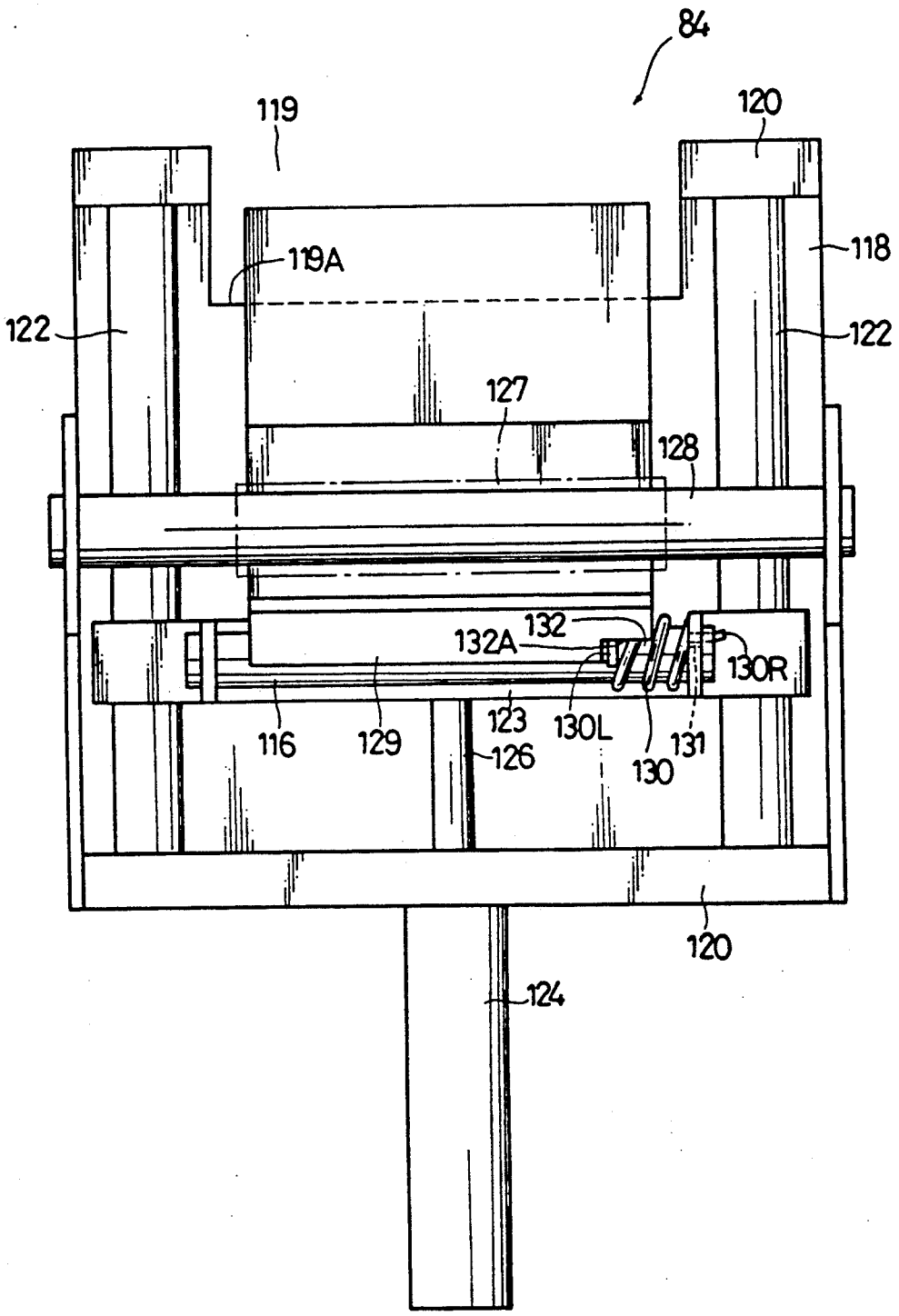
FIGS. 18 and 19 are a front view and a left-side view, respectively, showing the mechanism incorporated in the machine, for folding the lower-inner flap of each cardboard case.
Figure 19:
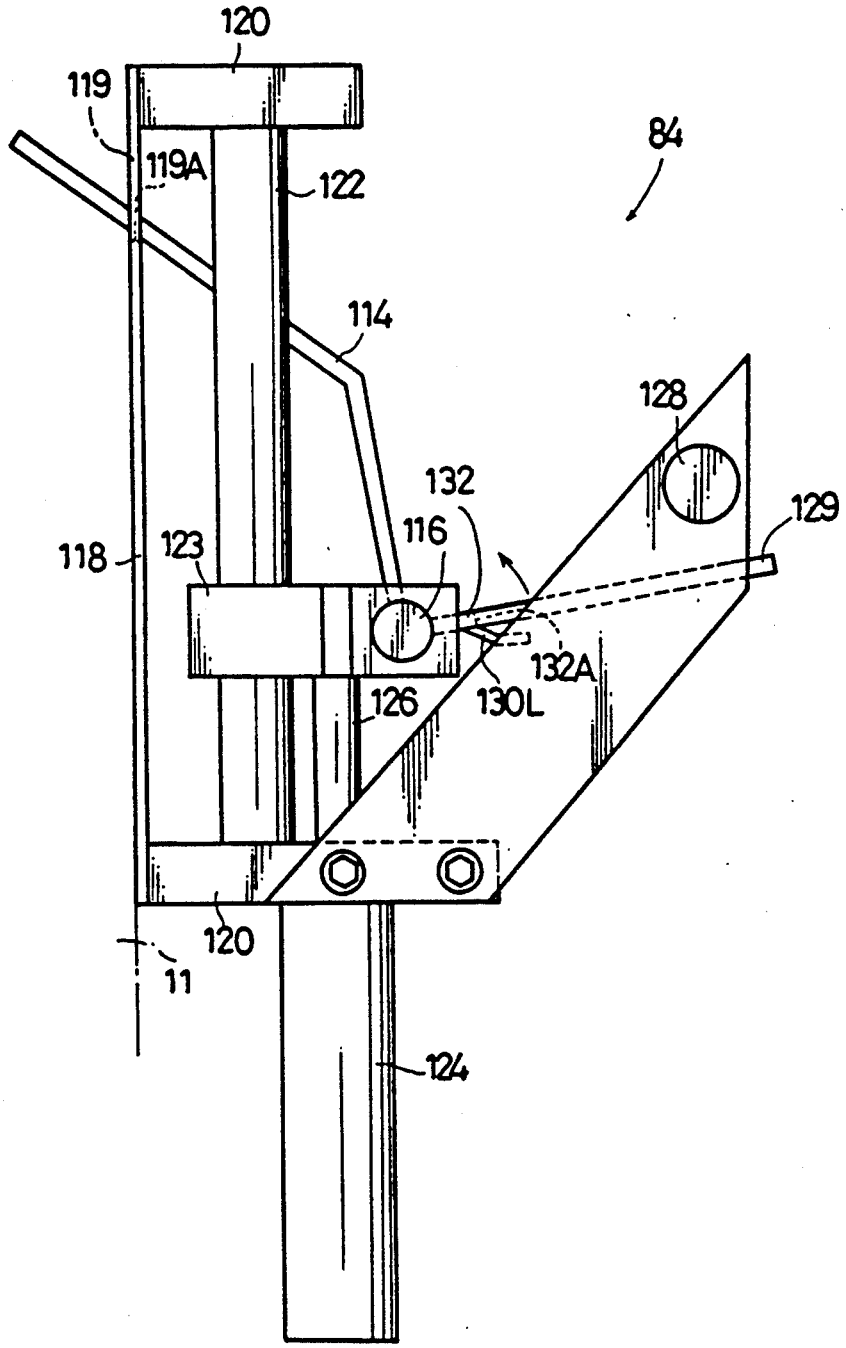

As is illustrated in FIGS. 18 and 19, the inner-flap folder 84 of flap-folding mechanism 30 comprises flap-folding member 114 which is rotatable, and shaft 116 to which member 114 is welded. Shaft 116 extends horizontally, and can be moved up and down while remaining in the horizontal position. To be more specific, shaft 116 is coupled to slider 123 which is slidably mounted on a pair of shafts 122 spaced apart in the horizontal direction and both extending vertically between two supports 120. These supports 120 are fastened to the upper and lower ends of bracket 118, respectively, which in turn is fixed to the frame 11 of case-assembling machine 10. Bracket 118 has a broad notch 119 in its upper end. Cylinder mechanism 124 is coupled to the lower surface of lower support 120. The piston 126 of cylinder mechanism 124 passes through lower support 120 and is connected, at its upper end, to slider 123. Operation plate 129 is welded to shaft 116.

As can be clearly understood from FIG. 18, flap-folding member 114 is shaped such that it can abut on the edge 119A of notch 119 cut in bracket 118. Torsion spring 130 is wound around shaft 116, with its right end 130R inserted in hole 131 made in slider 123 and its left end 130L biased onto the edge 132A of notch 132 cut in the lower-right portion of operation plate 129. Hence, torsion spring 130 urges operation plate 129 to rotate counterclockwise as represented by the arrow in FIG. 19. Further, the upper end portion of flap-folding member 114 is bent downward such that, in its initial position, flap-folding member 114 abuts on the edge 119A of notch 119, and plate 129 is located below shaft 128.

Inner-flap folder 84 operates in the following manner. Holder 84 stays in its initial position shown in FIGS. 19 and FIG. 20(A), which can blow the end panel 12A of cardboard case 12 mounted on the flap-folding stage. As can be seen from FIG. 21, the suction cups 20 of case opening mechanism 28 still keep holding cardboard case 12 which is already transported to the flap-folding station, and the flap-folding member 26 of mechanism 28 remains in its operation position, thus holding the upper-inner flap F1L of case 12. Since inner flap F1L has been folded downward no sooner than cardboard 12 had been moved upward from magazine 14, both outer flaps are pushed open by inner flap F1U. Hence, neither outer flap is in such a position as to hinder a smooth upward folding of lower-inner flap F1L.

Figure 20:
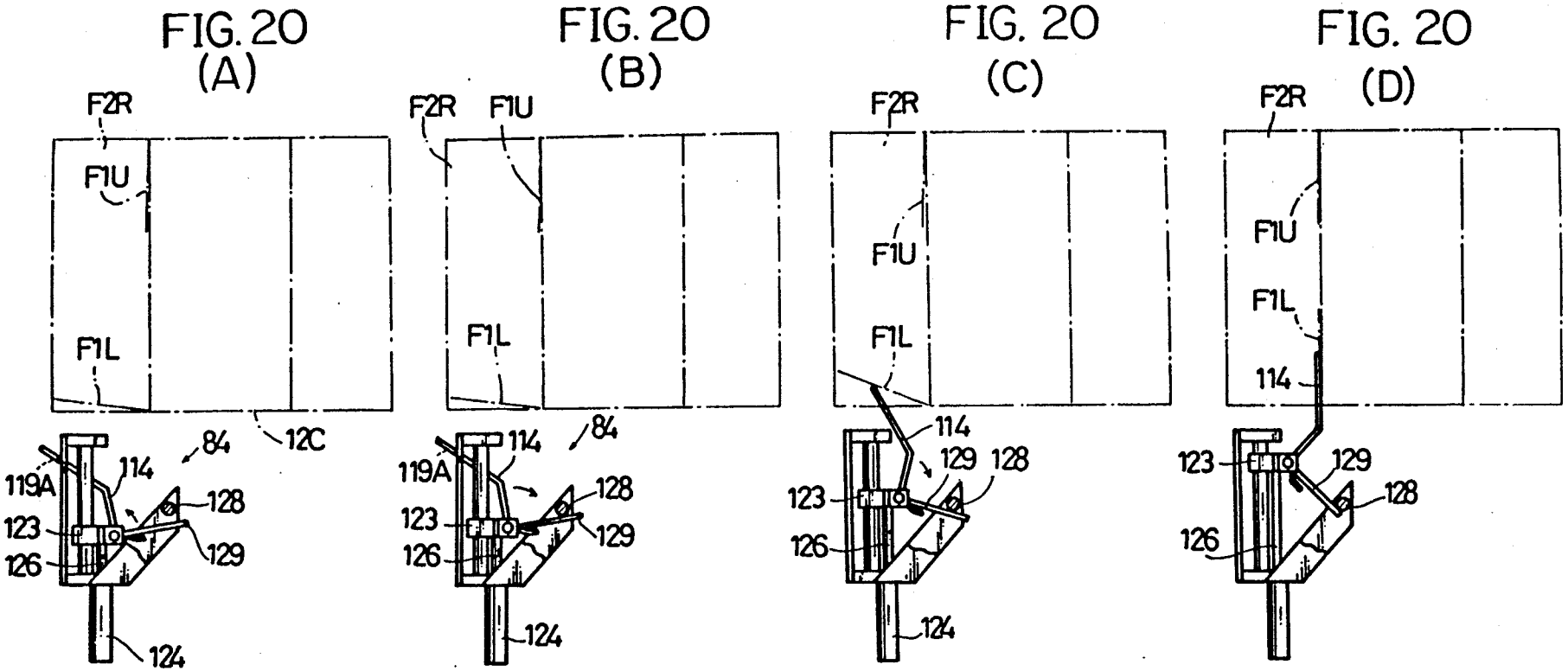
FIGS. 20(A) to 20(D) are side views of the mechanism for folding the lower-inner flap of each case, explaining how this mechanism folds the lower-inner flap of the case.
Figure 21:
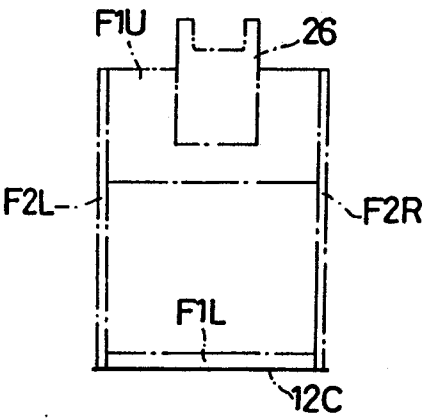
FIGS. 21(A) to 21(D) are front views of the inner flap-folding mechanism, explaining how this mechanism folds the lower-inner flap of the case.
Figure 21:
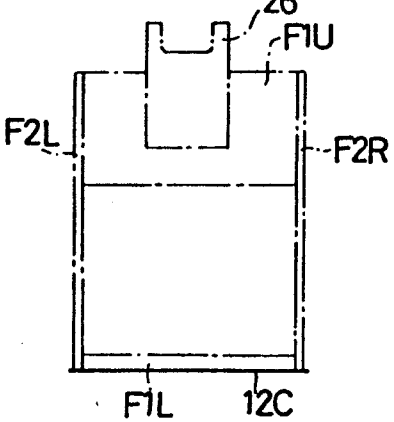
Figure 21:
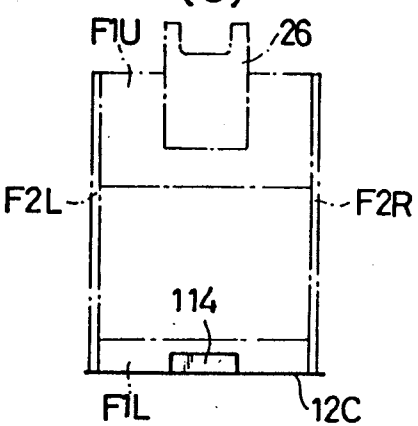
Figure 21:
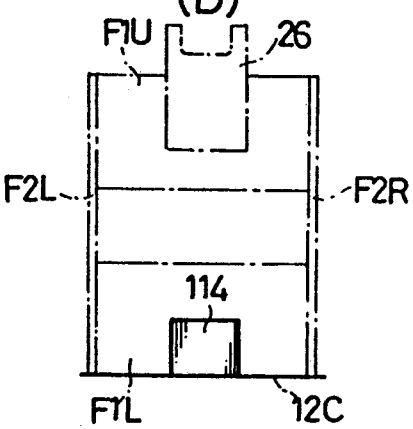

Then, cylinder mechanism 124 is driven, whereby piston 126 extends outward, lifting slider 123. Hence, shaft 116 attached to slider 123 is also lifted. Since the biasing force of torsion spring 130 is applied to shaft 116, both flap-folding member 114 and operation plate 129 are rotated counterclockwise as shaft 116 is moved up, as is illustrated in FIG. 20. Eventually, plate 129 abuts on shaft 128, whereby plate 129 can no longer rotate counterclockwise, as is shown in FIG. 20(B). Then, flap-folding member 114 is rotated clockwise as shaft 116 is lifted further, as is illustrated in FIGS. 20(B) and 20(C). In the position shown in FIGS. 20(A) and 20(B), flap-folding member 114 is located below cardboard case 12 and is thus unable to fold lower-inner flap F1L of cardboard case 12, as may be understood from FIGS. 21(A) and 21(B). When member 114 is further rotated clockwise, however, the upper end of member 114 rises above the bottom of case 12, as is illustrated in FIGS. 20(C) and 21(C). Therefore, member 114 starts folding inner flap F1L upward. As inner flap F1L is folded upward, it makes no bridging whatever with either outer flap F2L or F2R since both outer flaps are fully opened or pushed aside by upper-inner flap F1U which has been already folded downward. As a result, lower-inner flap F1L is easily folded upward as is shown in FIG. 20(D) and FIG. 21(D).

Rubber sheet 127 is wrapped around shaft 128, thus reducing the shock which operation plate 129 suffers when abutting on shaft 128. Therefore, lower-inner flap F1L can be folded upward readily even if cardboard case 12 is displaced in the Y-axis direction.

Figure 22:
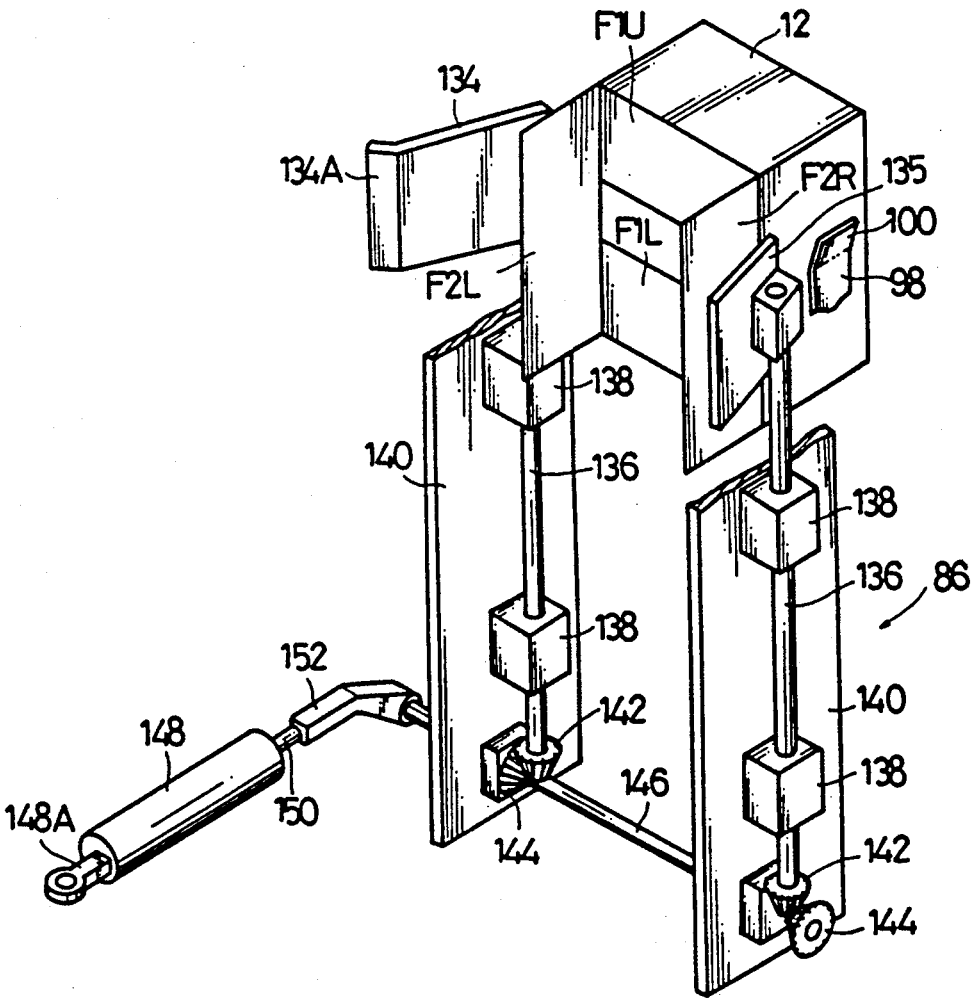
FIG. 22 is a perspective view illustrating the mechanism incorporated in the machine, for folding the outer flaps of each case.
Figure 23:
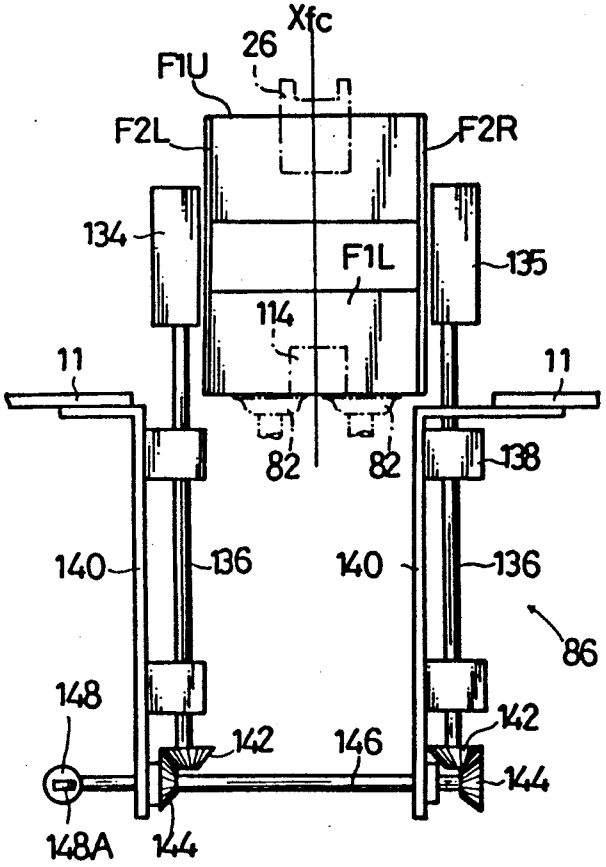
FIGS. 23(A) and 23(B) are front views of the outer flap-folding mechanism, explaining how this mechanism folds the left and right outer flaps of the case.
Figure 23:
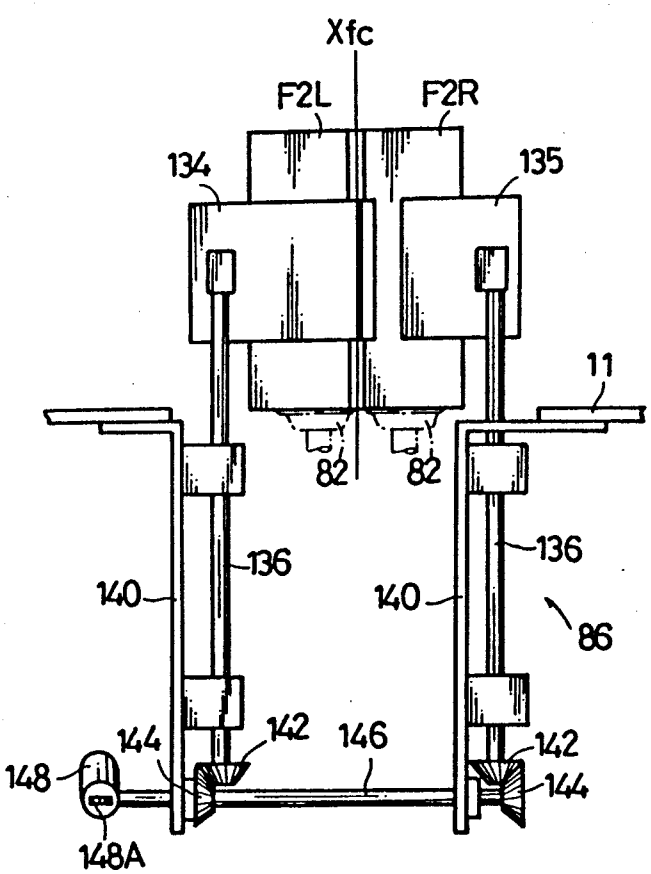

After lower-inner flap F1L has been folded, outer-flap folder 86 is operated. As is shown in FIG. 22, holder 86 comprises left flap-folding member 134 and right flap-folding member 135. Both flap-folding members 134 and 135 secured to upper ends of two shafts 136, respectively, which are pivotally supported by supports 138. Either support 138 is attached to frame bracket 140 which in turn is fastened to the frame 11 of case-assembling machine 10, as is illustrated in FIG. 23(A). Bevel gear 142 is mounted on the lower end of either shaft 136. Bevel gear 144, which meshes with bevel gear 142, is mounted on horizontal shaft 146 extending through both brackets 140. Cylinder mechanism 148 having piston 150 is connected at its proximal end 148A to the frame 11 of case-assembling machine 10. The distal end of piston 150 is coupled by coupler 152 with horizontal shaft 146. Coupler 152 is a flexible one, and is rotated when shaft 146 is rotated.

As is shown FIGS. 22 and 23(A), flap-folding members 134 and 135 are set apart from outer flaps F2L and F2R, respectively, when outer-flap folder 86 is in its initial position. When cylinder mechanism 148 is actuated, thus extending piston 150 outward, shaft 146 is rotated. As a result, both shafts 136 are rotated since bevel gears 144 mounted on shaft 146 are in mesh with bevel gears 140 mounted on the lower ends of shafts 136. Flap-folding members 134 and 135, which are mounted on shafts 136, are therefore rotated, folding outer flaps F2L and F2R inwardly as is illustrated in FIG. 23(B).

Figure 24:
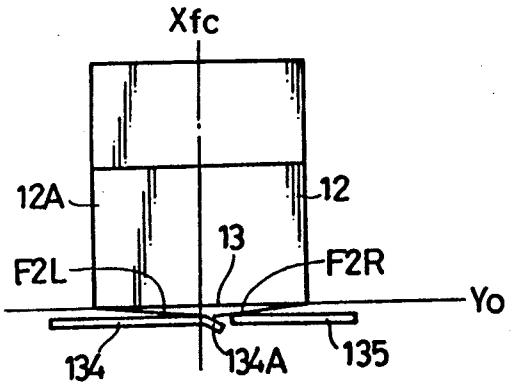
FIG. 24 is a top plan view of the corrugated cardboard case with its left and right outer flaps already folded by means of the outer flap-folding mechanism.

Both flap-folding members 134 and 135 function not only to fold outer flaps F2L and F2R, but also to guide cardboard case 12 from the flap-folding station to the case-sealing station in the following manner. Cylinder mechanism 148 is actuated such that flap-folding members 134 and 135 do not fold outer flaps F2L and F2R up until flaps F2L and F2R are completely aligned with the reference line $Y_0$; flaps F2L and F2R are not completely folded as is shown is FIG. 24. This is an important feature. Were flaps F2L and F2R completely folded and aligned with line $Y_0$, the friction between each outer flap and the flap-folding member would increase, rendering it difficult to smoothly transport cardboard case 12 to the case-sealing station, and the reaction of flaps F2L and F2R would be great enough to topple case 12. As is shown in FIG. 24, left flap-folding member 134 longer than right flap-folding member 135, extending beyond the reference line Xfc of the flap-folding station, and its distal end 134A, which is beyond line Xfc, is bent outwardly. Since the distal end 134A of member 134 is thus bent, right outer flap F2R does not abut on distal end 134A of left flap-folding member 134 at all as cardboard case 12 is transported forward. Hence, case 12 is smoothly transported from the flap-folding station to the case-sealing station.

As a comparison between FIG. 23(A) and FIG. 23(B) may show, flap-folding members 26 and 114, which are designed for folding inner flaps F1U and F1L, respectively, are removed from their flap-folding positions as soon as flap-folding members 134 and 135 start rotating to fold outer flaps F2L and F2R inward. More specifically, the moment flap-folding members 134 and 135 are rotated, thus folding flaps F2L and F2R to some extent, the vacuum is released from all suction cups 20 of case-opening mechanism 28, and rotatable arm 22 is lited, whereby member 26 attached to arm 22 is smoothly pulled out of cardboard case 12. Thereafter, 90° -actuator 64 is driven, thus returning flap-folding member 26 to the initial position, and arm 22 is rotated back to its initial position above stocker 14. Hence, case-opening mechanism 28 becomes ready to open the uppermost one of the cases 12 stacked on magazine 14.

Almost at the same time flap-folding member 26 is pulled from cardboard case 12, cylinder mechanism 124 is actuated, thereby lowering piston 126. As a result, flap-folding member 114 is pulled from cardboard case 12. Although torsion spring 130 urges flap-folding member 114 to rotate, operation plate 129 abuts on shaft 128, whereby flap-folding member 114 is prevented from rotating, until it is completely pulled out of cardboard case 12. When flap-folding member 114 is completely pulled out from case 12, it starts rotating. Then member 114 and piston 126 return to their respective initial positions as shown in FIG. 19. Thus, flap-folding mechanism 30 becomes ready to fold the flaps of the next cardboard case 12 which is to be transported to the flap-folding station.

When lower-inner flap F1L and both outer flaps F2L and F2R of cardboard case 12 have been folded, rodless cylinder mechanism 92 (FIG. 16) is driven, thus sliding slider 90 on guide 94 for distance L2 to the left. Cardboard case 12 attracted to suction cups 82 mounted on slider 90 is therefore positioned in alignment with the reference line Xsc of the case-sealing station. In other words, when cardboard case 12 is moved to the left from the flap-folding station for distance L2, it is automatically aligned with reference line Xsc of the case-sealing station. Guides 154, 156 and 157 secured to frame 11 continuously guide cardboard case 12 before case 12 is released from flap-folding members 134 and 135 which also guide case 12 as is shown in FIG. 7.

As has been described above, cardboard case 12 is fixed on the case-sealing station before case-sealing mechanism 40 is operated to seal cardboard case 12. Cardboard case 12 is held on the case-sealing station by means of case-holding mechanism 160 shown in FIGS. 25 and 26. As is shown in these figures, case-holding mechanism 160 comprises first case holder 162 for pushing cardboard case 12 vertically, and second case holder 164 for pushing case 12 horizontally from behind the back of case 12 on guides 156 and 157.

Figure 25:
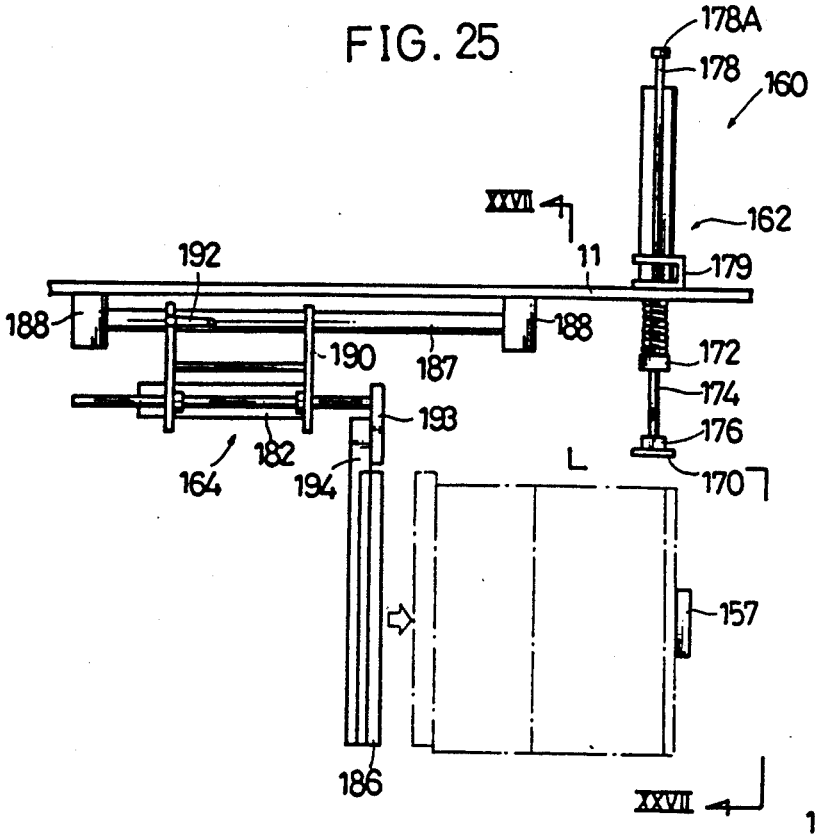
FIGS. 25 and 26 are a left-side view and a schematic front view, respectively, illustrating the case-holding mechanism for holding each case at the case-sealing station of the machine.
Figure 26:
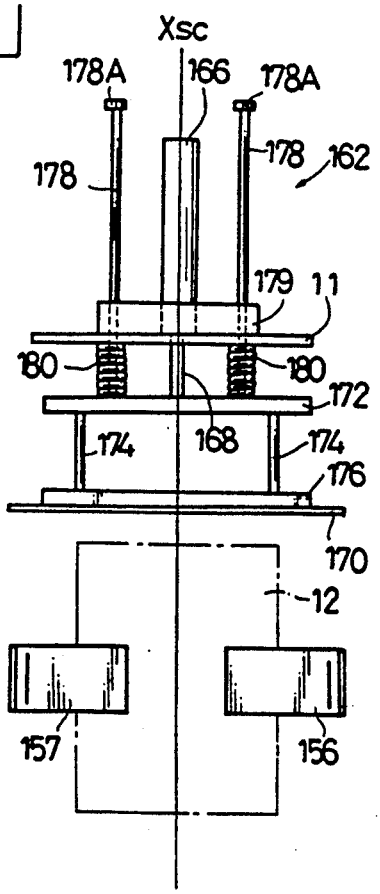

As is shown in FIGS. 25 and 26, first case holder 162 comprises cylinder mechanism 166 including piston 168, and plate 170. The lower end of piston 168 is coupled to upper slider 172 which is a horizontal flat bar. Slider 172 is connected to lower slider 176 by means of two vertical rods 174. Plate 170 is attached to the lower surface of lower slider 176. First case holder 162 further comprises a pair of guide bars 178 which extend vertically, parallel to cylinder mechanism 166. Guide bars 178 extend upward from upper slider 172, passing through the holes made in frame 11 and slidably supported by support 179. Stopper 178A is connected to the upper end of either the guide bars 178, so that guide bar 178 may not fall, slipping from support 179 and frame 11. Compression coil spring 180 is wound around either guide bar 178 and is interposed between frame 11 and upper slider 172. As piston 158 extends downward, plate 170 is lowered to push lower edge 13 of case 12 and also the upper sides of outer flaps F2L and F2R.

Figure 27:
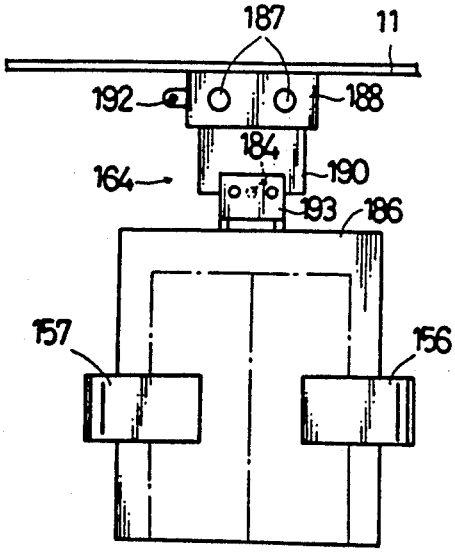
FIG. 27 is a front view of the case-holding mechanism taken along line XXVII—XXVII.

As is shown in FIGS. 25 and 27, second case holder 164 comprises cylinder mechanism 182 and plate 168. Mechanism 182 includes a piston 184. A pair of guide bars 187 extend horizontally, parallel to each other, passing through holes made in support 188 attached to the lower surface of frame 11. Slider 190 slidably mounted on guide bars 187 is locked thereto by means of lock lever 192. Cylinder mechanism 182 is horizontally attached to slider 190. Coupler 193 is connected to the distal end of piston 184. A pair of steel bars 195 are connected to coupler 193. Plate 186 is secured to these steel bars 194 and extends downward therefrom. As piston 184 extends horizontally to the right (FIG. 25), plate 186 is moved in the same direction, thus contacting the back of case 12 and pushing case 12 to the right.

Figure 28:
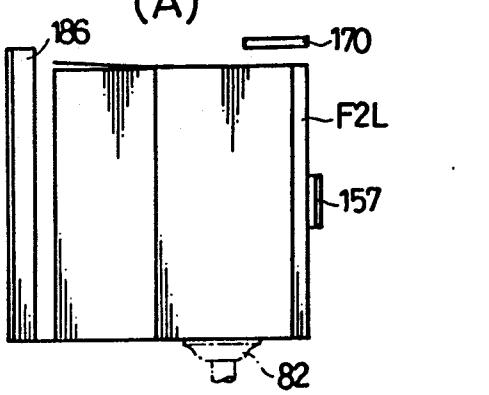
FIGS. 28(A) to 28(C) are left-side views of the case-holding mechanism, representing how this mechanism holds each case at the case-sealing station.
Figure 28:
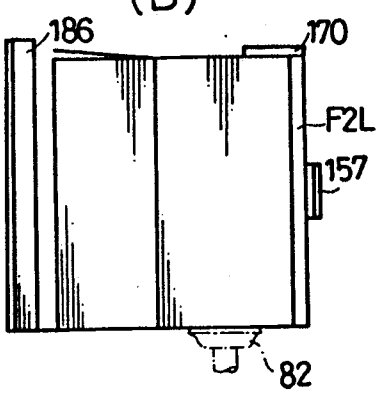
Figure 28:
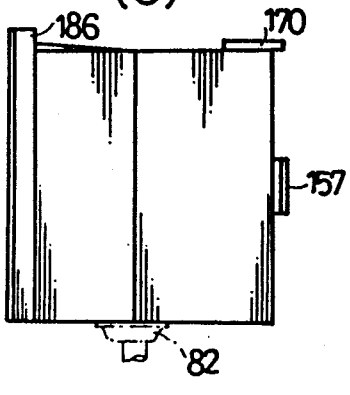
Figure 29:
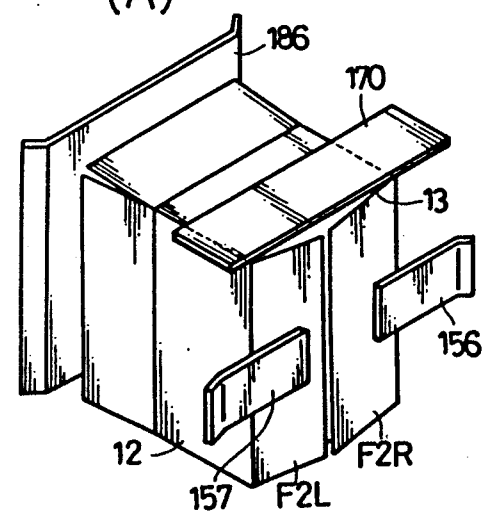
FIGS. 29(A) to 29(C) are perspective views of the case-holding mechanism, explaining how this mechanism holds each case at the case-sealing station.
Figure 29:
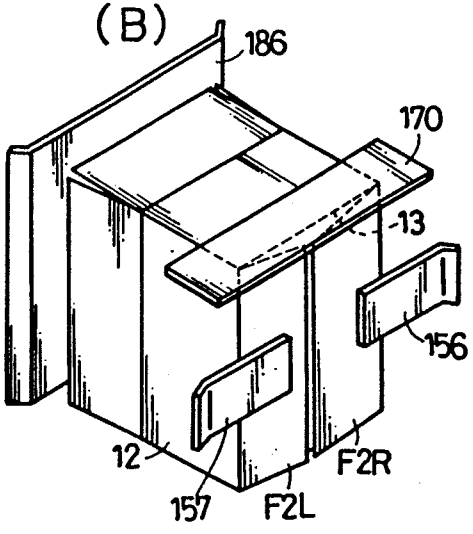
Figure 29:
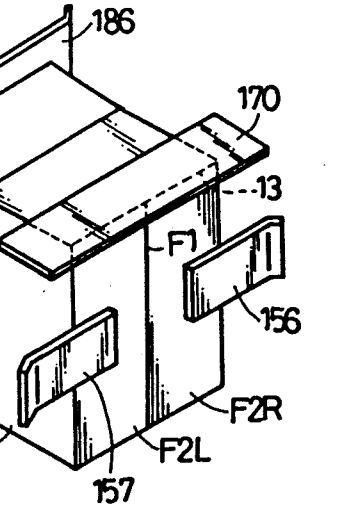

Case-holding mechanism 160 operates in the following way to hold cardboard case 12 on the case-sealing station. As is shown in FIG. 28(A), case 12 transported from the case-sealing station and aligned with the reference line Xsc is set apart from both the plate 170 of first case holder 162 and the plate 186 of second case holder 164. Nonetheless, as is evident from FIG. 29(A), both outer flaps F2L and F2R are lightly pressed onto guides 156 and 157, respectively. In this condition, cylinder mechanism 166 is actuated, thus thrusting piston 168 downward. Hence, plate 170 is lowered and presses end panel 12A of cardboard case 12. The force which plate 170 applies to end panel 12A is the biasing force of compression spring 180, and is not strong. Since plate 170 lightly presses the lower edge 13 of case 12 and the upper sides of outer flaps F2L and F2R, case 12 is not distorted or deformed, and remains upright while lightly clamped between suction cups 82 and plate 170, as is illustrated in FIGS. 28(B) and 29(B).

While holding case 12 upright between cups 82 and plate 170, cylinder mechanism 182 is actuated, thereby thrusting piston 184 to the right. Plate 186, which is connected to piston 184 by coupler 193 and steel bars 194, is moved to the right, contacting and pushing the back of case 12. Plate 186 is large enough to touch the entire back of case 12. Plate 186 is moved to the right until the front of case 12 goes into contact with guides 156 and 157. Thus, cardboard case 12 is held between plate 186 and guides 156, 157. In this condition, both outer flaps F2L and F2R are completely folded, with their opposing edges F' abutting on each other and extending vertically along the center line of cardboard case 12.

Case-sealing mechanism 40 (e.g., the sealing machine manufactured by SIAT, Inc.) is operated to move up, thus applying a sealing member such as the adhesive tape 44 to the abutting edges F' of flaps F2L and F2R, which extend vertically. The position of mechanism 40 need not be adjusted in order to seal cardboard cases of different sizes. This is because, as has been explained, any cardboard case 12 of whichever size supplied to the case-sealing station is positioned such that its center line is aligned with the reference line Xsc of the case-sealing station. In addition, since each cardboard case 12 is held immovable during the sealing process, it can be sealed by means of staples.

Upon completion of the sealing process, the vacuum is released from suction cups 82. These cups 82 are returned to their initial positions where they can hold the next cardboard case 12. A cardboard case 12, which has been thus sealed, temporarily remains at the case-sealing station. It is moved to the left from the case-sealing station as it is pushed by the next case 12 held by suction cups 82 and being transported to the case-sealing station.

Figure 17:
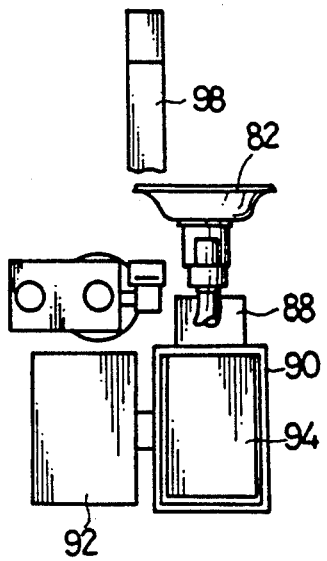
FIGS. 17(A) and (B) are a left-side view and a front view, respectively, illustrating the suction cups and the vibration-damping mechanism.
Figure 17:
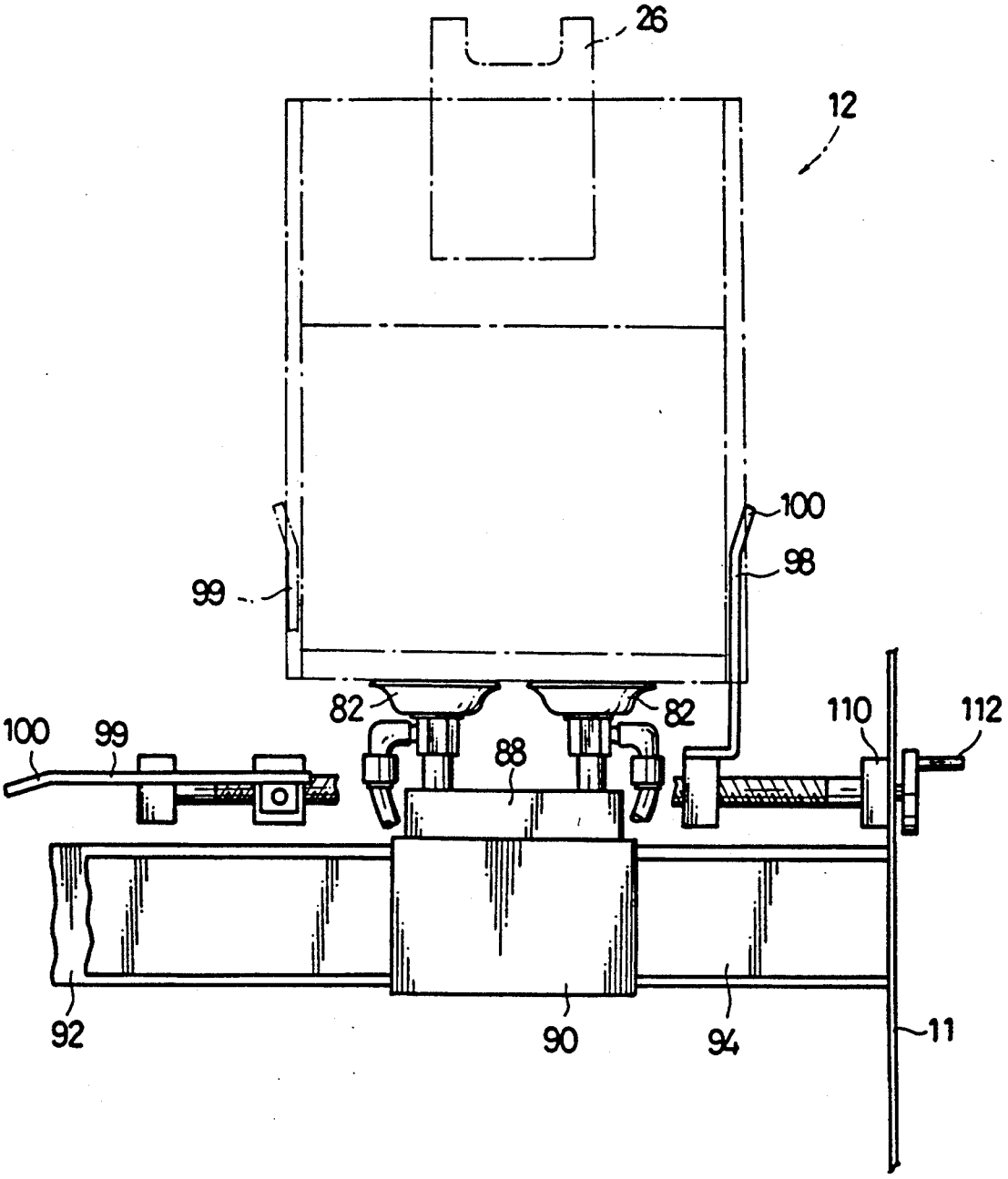
Figure 30:
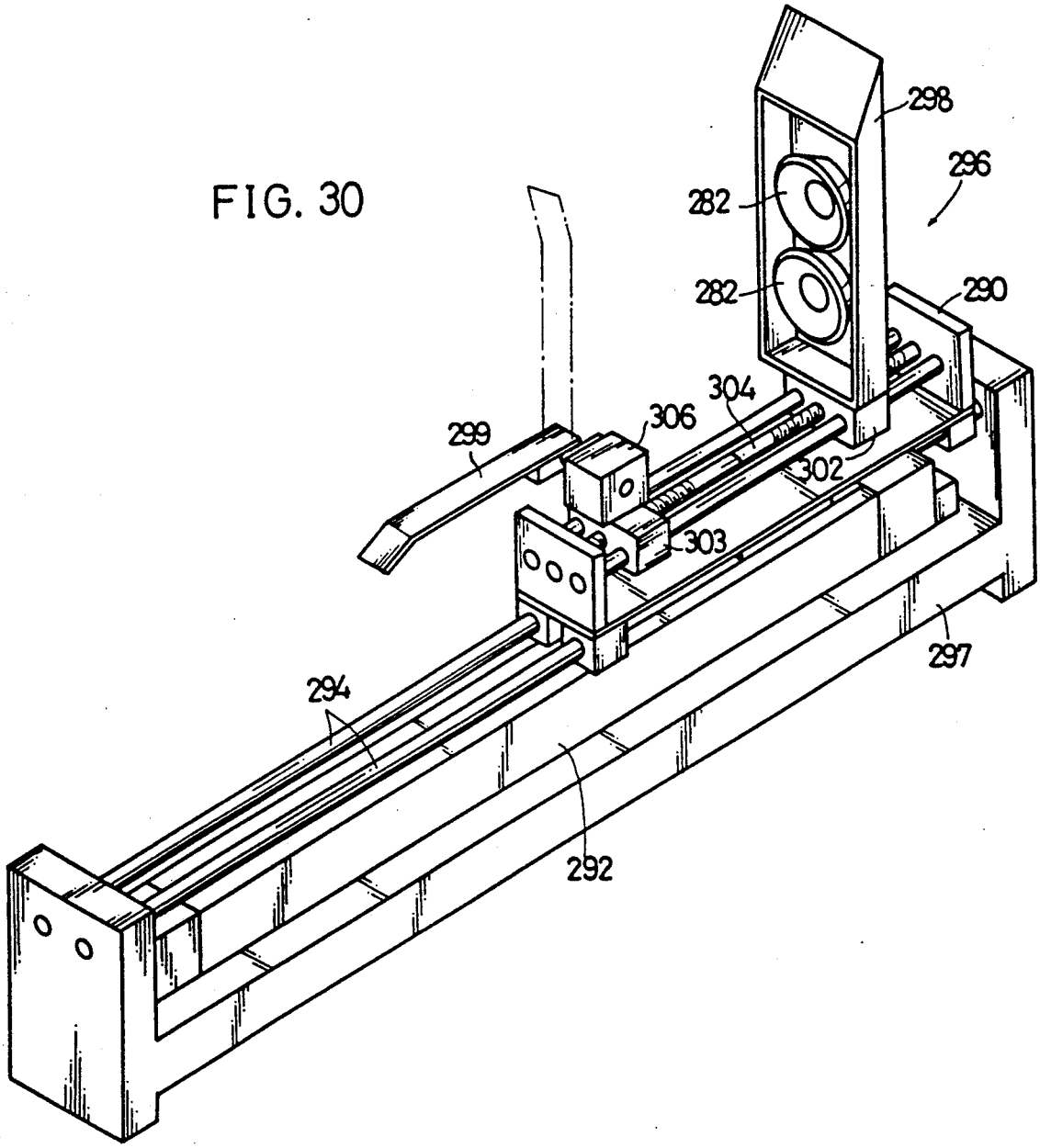
FIG. 30 is a perspective view showing a unit comprising suction cups and a vibration-damping mechanism.

Stopper mechanism 96 and suction cups 82 shown in FIGS. 16 and 17 can be assembled into such a single stopper mechanism 296 as is illustrated in FIG. 30. In this stopper mechanism 296, main body 297 is secured to frame 11, and rod-less cylinder mechanism 292 is mounted on main body 297. The stopper mechanism comprises a pair of guides 294 extending between the raised ends of rod-less cylinder mechanism 292, slider 290 slidably mounted on these guides 294, guides 298 and 299 slidably mounted on slider 290, and two suction cups 282 attached to guide 298.

The operation of stopper mechanism 296 will now be explained. First, drive shaft 304 is rotated, thus moving guides 298 and 299 until the distance between them becomes a little greater than the width W of cardboard case 12. Rotatable arm 22 holding case 12 is lowered until case 12 is placed in the gap between guides 298 and 299. Then, suction cups 282 are moved to the left until they contact one side of case 12. Both cups 282 are evacuated, thus creating a partial vacuum in them. As a result, cardboard case 12 is held between guides 298 and 299. After case 12 has been folded in the same way as has been described, rod-less mechanism 292 is actuated, thus sliding slider 290 along guides 294 to the left. Hence, case 12 held between guides 298 and 299, both mounted on slider 290, is transported from the flap-folding station to the case-sealing station.

Since suction cups 282 hold one side of cardboard case 12, case 12 is prevented from being deformed while it is mounted on the case-sealing station.

Figure 31:
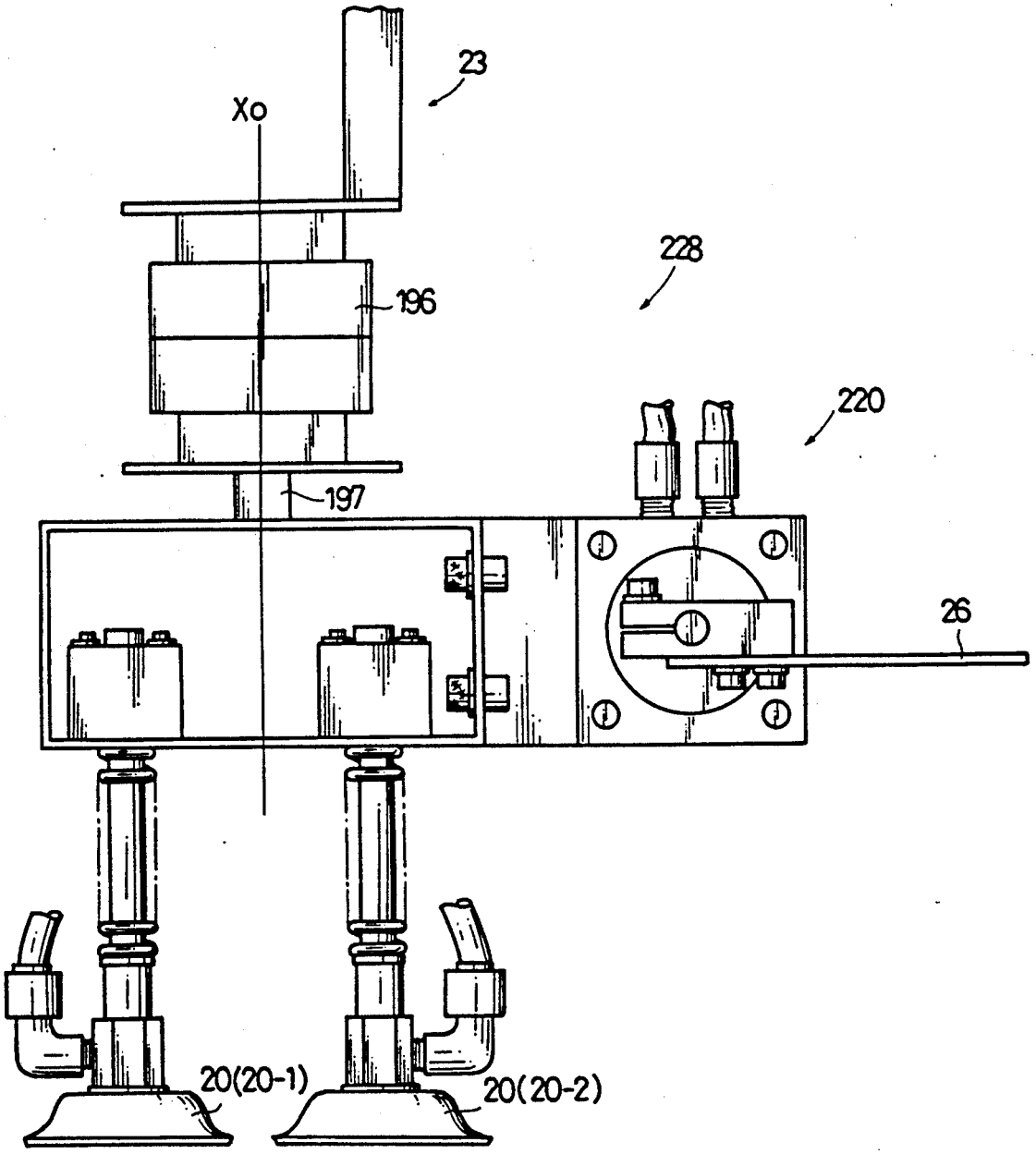
FIG. 31 is a side view of a case-opening mechanism, according to an alternate embodiment, which can rotate through an angle of 180°.
Figure 32:
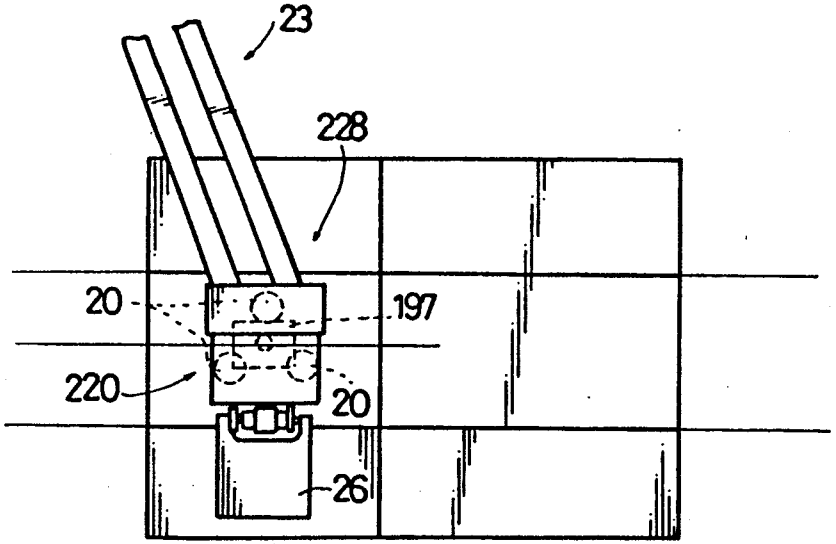
FIGS. 32(A) and 32(B) are top plan views of a part of the case-opening mechanism shown in FIG. 31, explaining how the mechanism operates.
Figure 32:
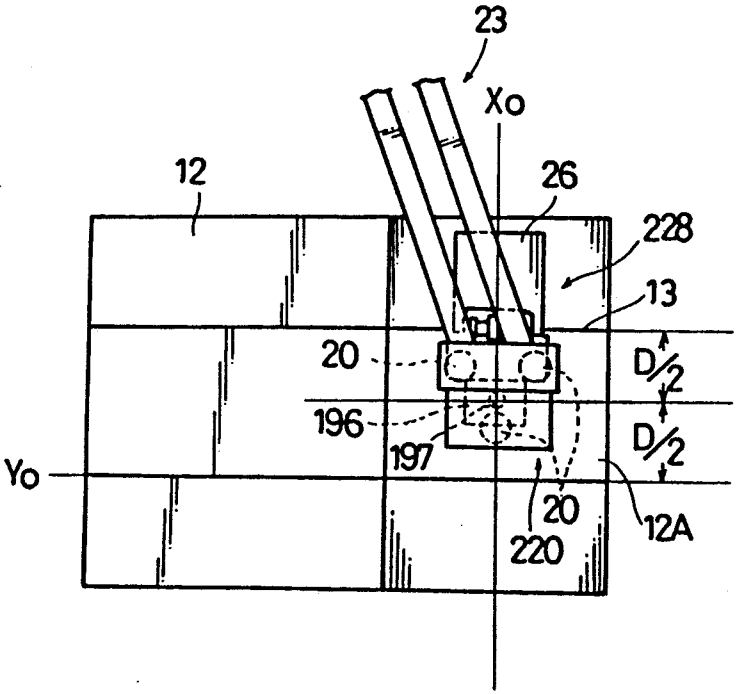

Data is usually printed in the same manner on the top and bottom panels of a cardboard case 12. In some cases, however, printing data is turned upside down. A cardboard case thus printed with data is called on "upside down case." To open such a cardboard case, it suffices to rotate cups 20 and flap-folding member 26 together, through 180°. FIG. 31 illustrates case-opening mechanism 228 which is designed to open upside down cardboard cases. Mechanism 228 is different from case-opening mechanism 28 in two aspects. First, 180°-actuator 196 is connected to support block 23 which in turn is connected to the distal end of rotatable arm 22. Second, unit 220, which is a combination of suction cups 20 and flap-folding member 26, is fastened to the shaft 197 of 180°-actuator 196. As is shown in FIGS. 32(A) and 32(B), the shaft 197 of 180°-actuator 196 is aligned with the reference line $X_0$ and set apart from the reference line $Y_0$ for the distance equal to half the depth D of case 12 (i.e., D/2). Unit 197 is fastened to shaft 197 such that flap-folding member 26 can fold upper-first flap F1U of flat-folded case 12. As can be clearly seen from FIG. 32(A), flat-folded cases 12 are stacked on magazine 14, each having the center line of its end panel 12A aligned with the reference line $X_0$, and its upper edge (not its lower edge 13) aligned with the reference line $Y_0$.

In operation, suction cups 20 are evacuated, thus holding flat-folded case 12. Then, 180°-actuator 196 is operated such that shaft 197 is rotated through 180°. Unit 220, which is fastened to shaft 197, is therefore rotated through 180°. As has been specified, shaft 197 is set apart from the reference line $Y_0$ for the distance of 2/D, and the lower edge 13 of flat-folded case 12 is aligned with the reference line $Y_0$. As a result, flat-folded case 12 automatically takes a desired position. Thereafter, cardboard case 12 is opened, shaped, and sealed, in the same way as has been explained.

Figure 33:
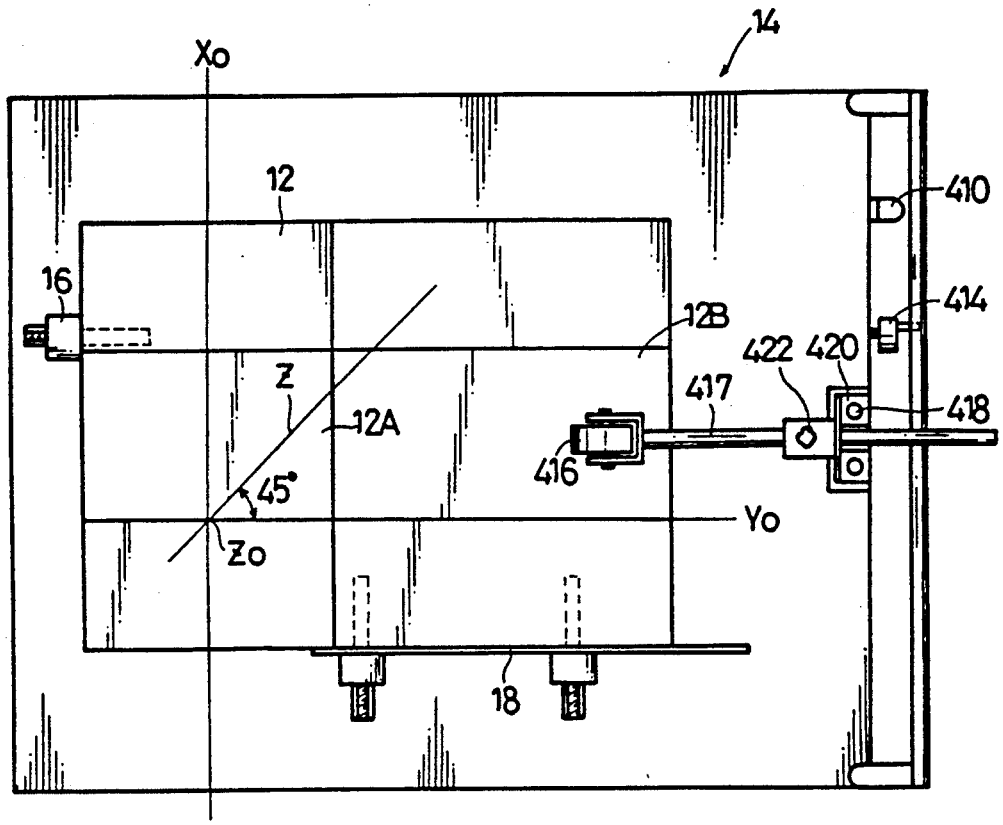
FIGS. 33 and 34 are a top plan view and a front view, respectively, showing the magazine used in the case-assembling machine.
Figure 34:
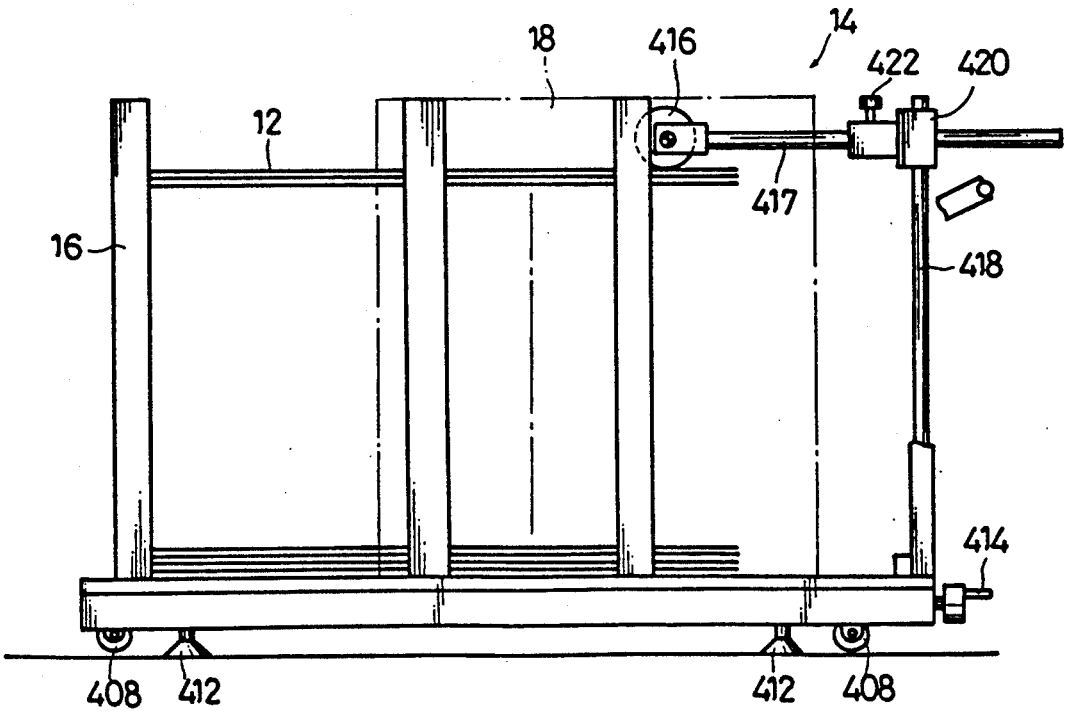

According to the present invention, magazine 14 can by modified such that it may function as a carrier, too. For instance, as is shown in FIGS. 33 and 34, casters 408, which can be moved up and down, are attached to the lower surface of magazine 14. When pedal 410 is depressed, casters 408 are lowered, whereby magazine 14 is used as a carrier. Alternatively, casters 408 can be replaced with ordinary casters, and the legs 412 of magazine 14 can be of the type which can be extended up or down. In this case, when pedal 412 is depressed, legs 412 are lifted, whereby magazine 14 can be used as a carrier.

Preferably, positioning members 16 and 18 are moved such that intersection $Z_0$ of reference lines $X_0$ and $Y_0$ moves in a straight line z intersecting with both lines $X_0$ and $Y_0$ at 45°. In this case, both positioning members 16 and 18 can be moved by rotating only one handle 411, to the desired positions determined by the width W of flat folded case case 12. Further, it is desirable that positioning members 16 and 18, and the guides 98 and 99 of stopper mechanism 96 be automatically moved in accordance with the input data representing the width W of case 12. In this case, a fully automatic case-assembling machine 10 will be provided.

As is shown in FIGS. 33 and 34, roller 416 is located such that it contacts the right portion of the side panel 12B of case 12, thus functioning as a weight. Since the right portion of case 12 is held by roller 416, side panel 12B is not raised in its entirety, and is gradually raised from its left portion adjacent to end panel 12A. Hence, no bridging occur, and case 12 can be smoothly opened.

Roller 416 is mounted on rod 417. Rod 417 is slidably supported by slider 420 which is slidably mounted on two vertical, parallel guide bars 418 arranged at the back of magazine 14. Rod 417 can thus be moved up and down. Roller 416, which is mounted on rod 417 can also be moved up and down. Since rod 417 can slide horizontally, back and forth, roller 415 can be moved in the horizontal direction for a desired distance in accordance with the size of flat folded preassembled cases 12. Roller 416 is set at a desired position, merely by operating lock handle 422, thereby fixing rod 417 to slider 420. Whenever a case is lifted from the stack of cases, roller 416 lowers, due to its own weight, to contact the uppermost case.

Figure 35:
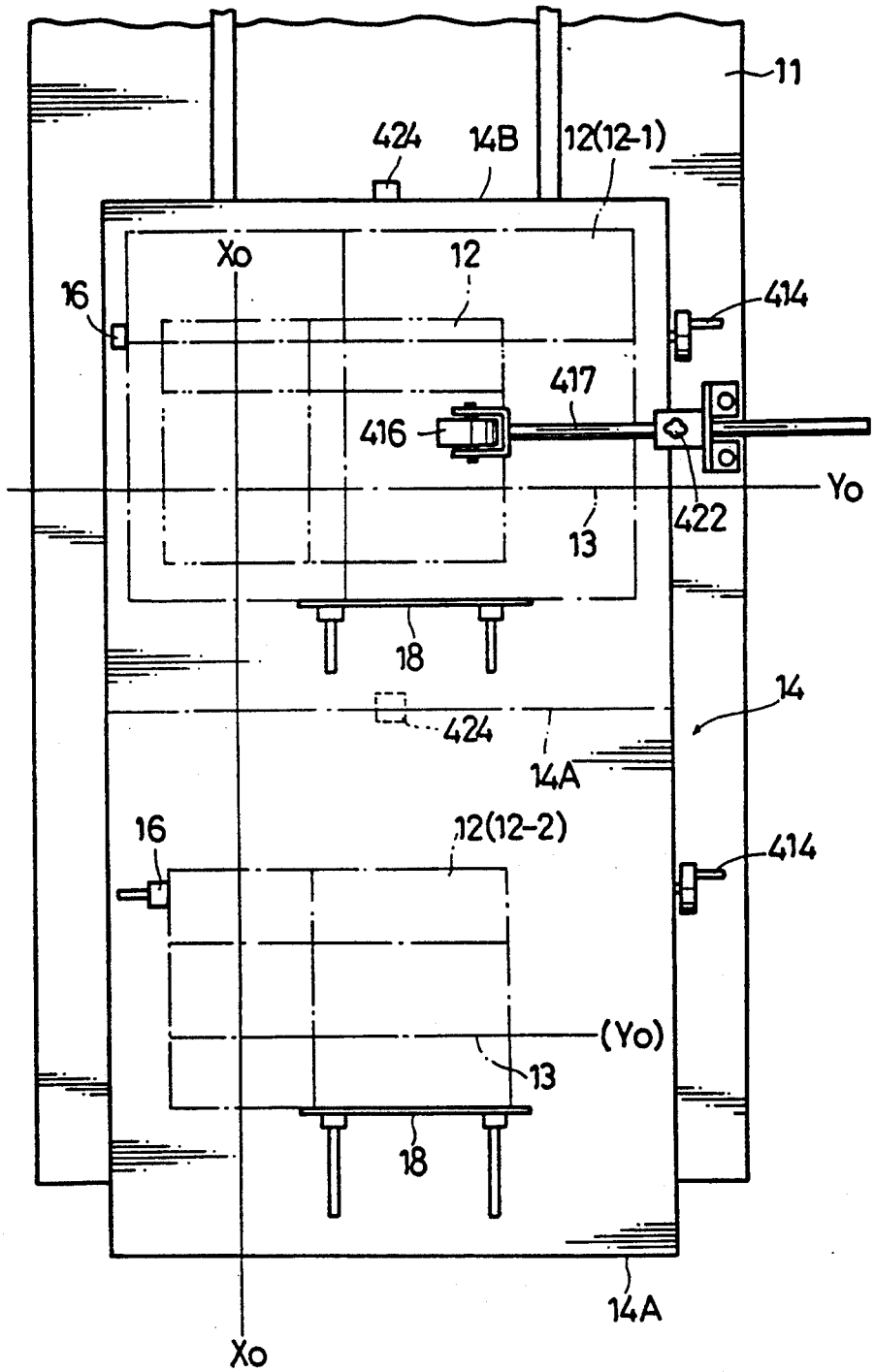
FIGS. 35 and 36 are a top plan view and a front view, respectively, showing a magazine of the shuttle type, according to another alternate embodiment of the invention.
Figure 36:
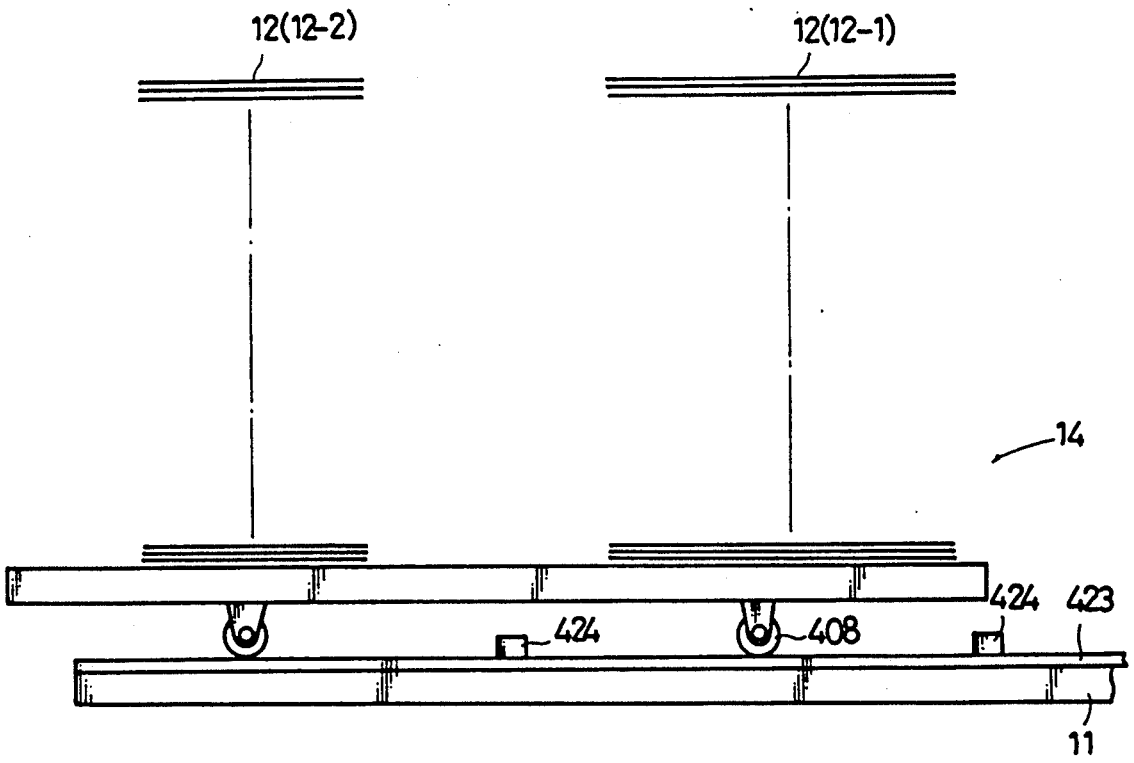

Furthermore, magazine 14 can be made to move on the frame 11 of machine 10, back and forth in the Y-axis direction, as is shown in FIGS. 35 and 36. In this case, flat-folded cases 12-1, 12-2, and so on, can be continuously opened one after another, thus ensuring a high case-assembling efficiency. This type of a magazine is called a "shuttle type" magazine. As is shown in FIG. 35, shuttle-type magazine 14 comprises two pairs of positioning members 16 and 18, which are used to position two flat-folded cases 12-1 and 12-2 of different sizes. More specifically, the lower edge 13 of the first case 12-1 is aligned with the reference line $Y_0$, whereas the second case 12-2 is positioned such that its lower edge 13 will be aligned with the reference line $Y_0$ when the front edge 14A of magazine 14 moves back to the position indicated by the one-dot chain line (FIG. 35). Proximity switch 424 mounted on frame 11, which functions as a sensor, detects the front and rear edges 14A and 14B of magazine 14, thus determining which case, case 12-1 or 12-2, is located at the case-opening position.

In the case of a shuttle-type magazine 14, roller 416 is provided at such a position above frame 11 that it does not collide with flat-folded case 12-1 while magazine 14 is being moved toward a desired position. Roller 416 is placed on case 12-1 after magazine 14 has reached the desired position. As is shown in FIG. 36, casters 408 of magazine 14 are mounted on rails 423.

As has been described above, each flat-folded case 12 is automatically set at a desired position when magazine 14 is positioned appropriately. Therefore, the shuttle-type magazine 14 can be used, whereby cardboard cases of different sizes are opened, shaped, and sealed easily and fast, continuously one after another.

Figure 37:
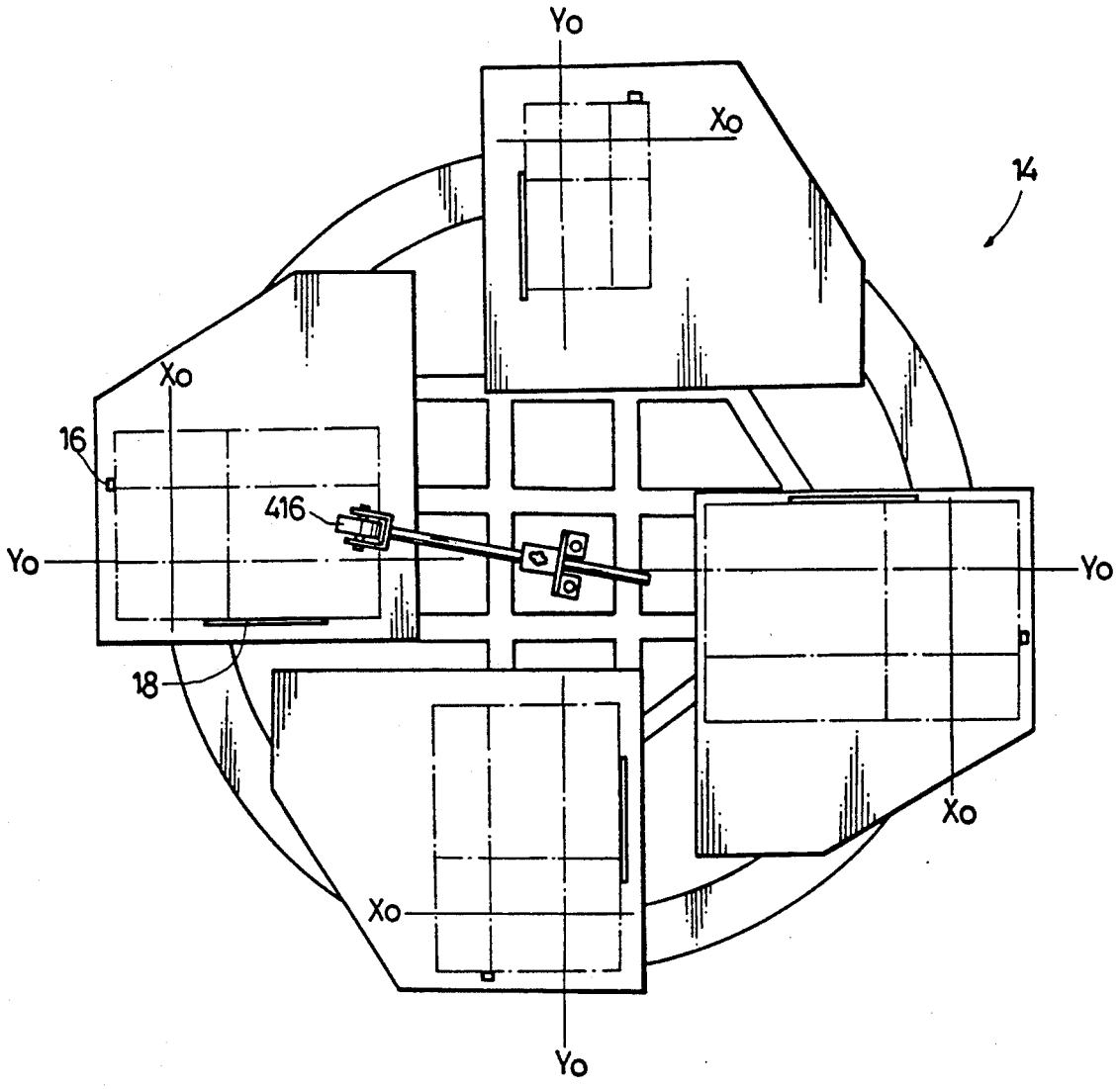
FIG. 37 is a top plan view schematically illustrating a magazine of the rotary type according to yet another alternate embodiment of the invention.
Figure 38:
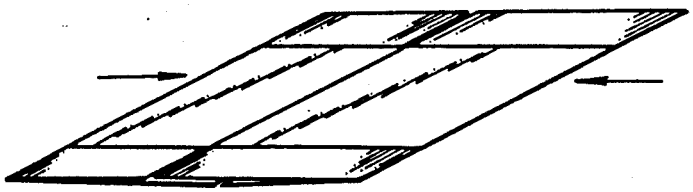
FIGS. 38(*a*) to 38(*f*) are perspective views of a flat folded preassembled case, explaining how the flat-folded case is assembled into an open case by the conventional method.
Figure 38:
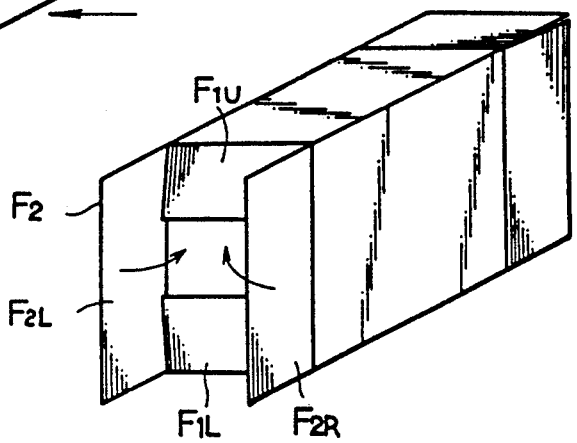
Figure 38:
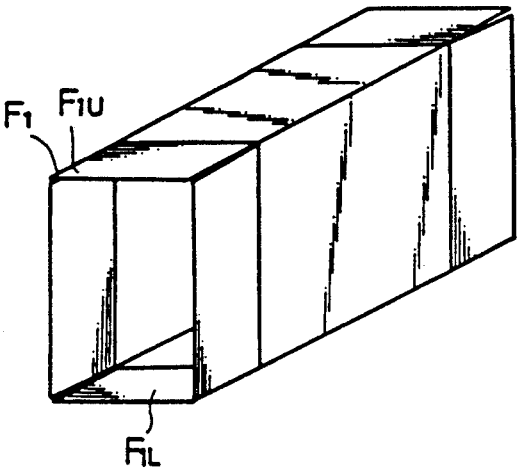
Figure 38:
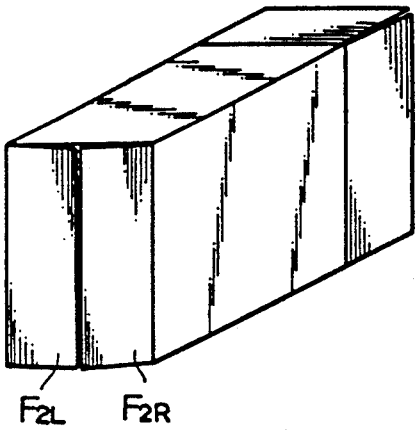
Figure 38:
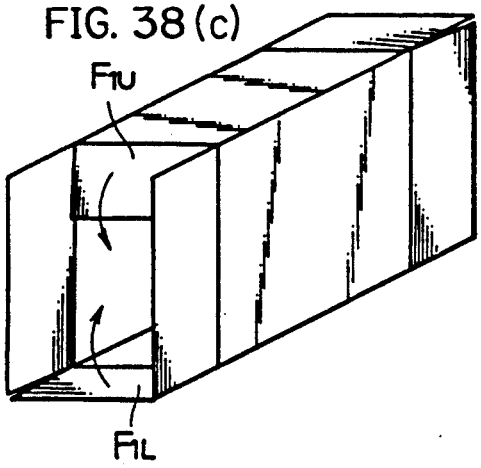
Figure 38:
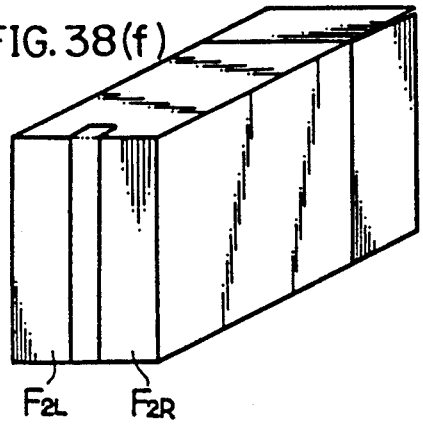
Figure 39:
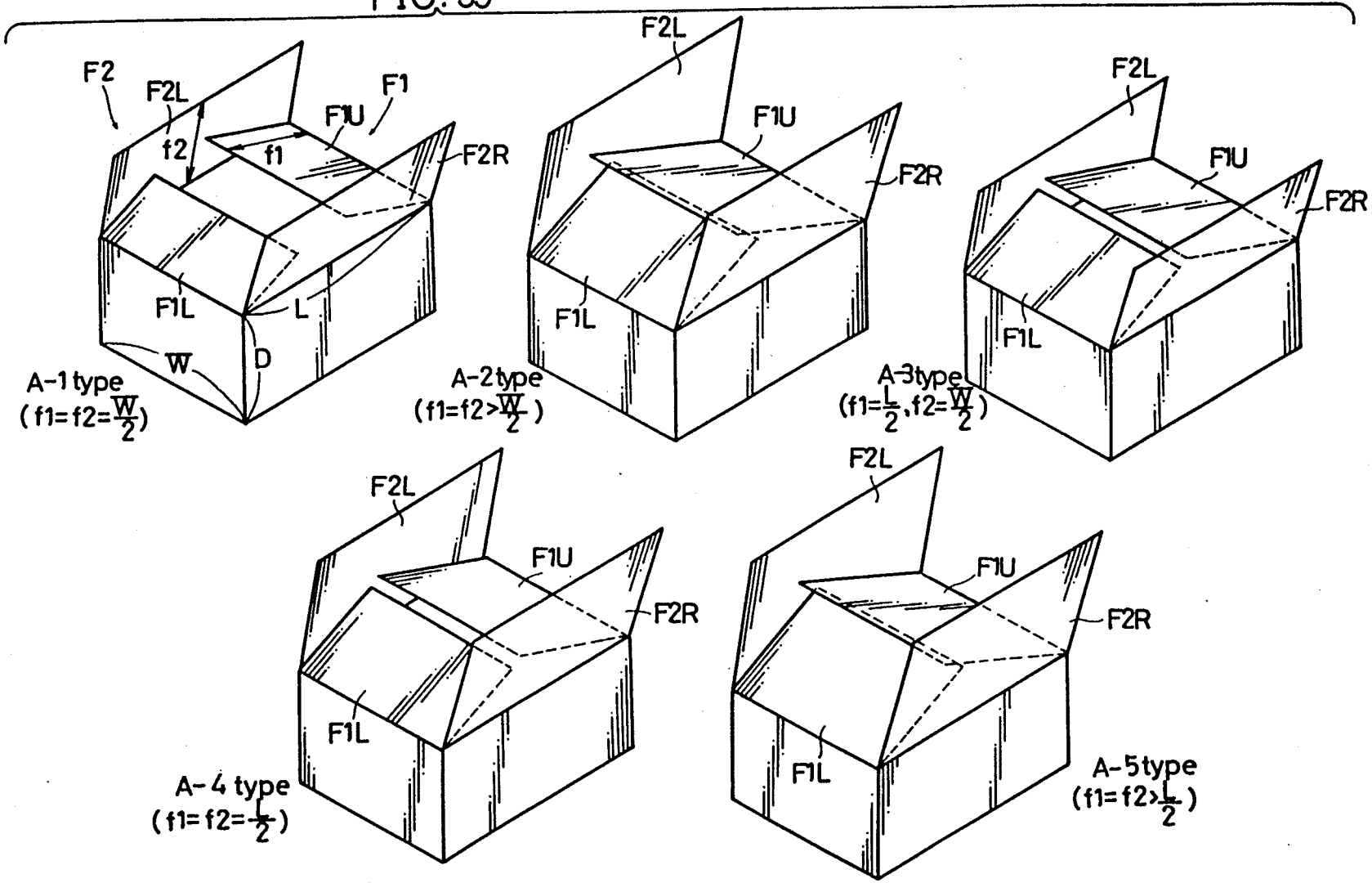
FIG. 39 shows perspective views of the A-1 to A-5 type cardboard cases.
Figure 40:
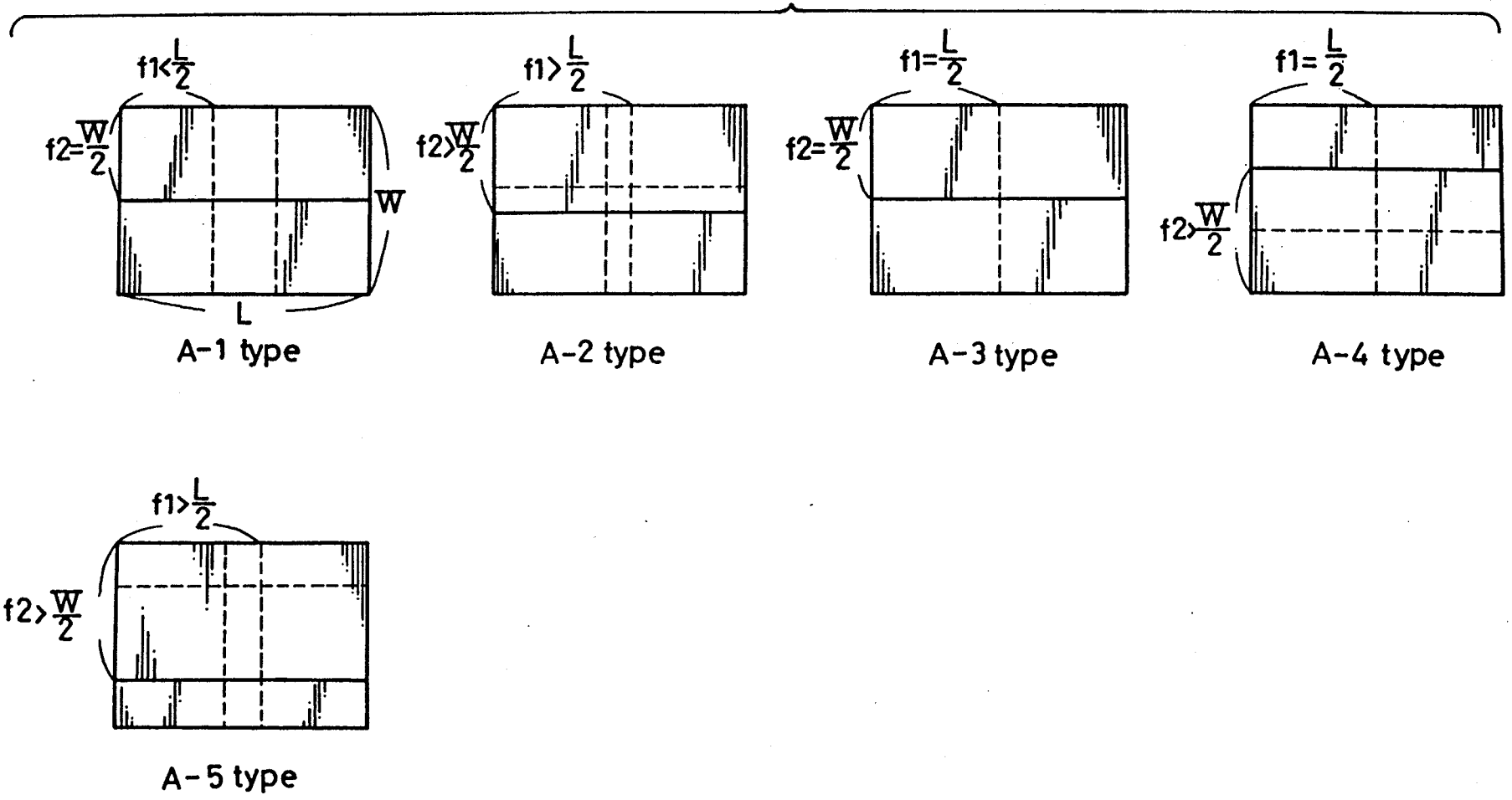
FIG. 40 shows the bottom views of the A-1 to A-5 type cardboard cases.

Still further, such a rotary-type magazine as is shown in FIG. 37 can be used in the present invention. The use of the rotary-type magazine 14 makes it possible to open, shape, and seal cardboard cases of different sizes easily and fast, continuously one after another. Needless to say, the case-assembling machine provided with the shuttle-type magazine or the rotary-type magazine can open, shape, and seal cardboard cases of the same size, equally fast one after another, since no delay occurs in positioning each flat-folded case on the magazine.

The case-assembling machine 10 according to this invention can process cases 12 of different sizes, thus assembling cardboard cases of different sizes, one after another. Obviously, machine 10 is versatile since it can assemble cases of various types, each type in a small quantity, in accordance with users' requests.

The description of the embodiment has been limited to the case where machine 10 assembles only A-1 type cardboard cases 12. Nevertheless, machine 10 can assemble A-3 type cardboard cases exactly in the same manner as A-1 type cases 12. Although machine 10 described above is suitable for assembling A-1 type cases or A-3 type cases, it can assemble A-2 type, A-4 type and A-5 type cases only if modified a little. For example, it can fold the flaps of an A-2 type, A-4 type, or A-5 type case if flap-folding mechanism 30 is modified so as to fold outer flaps F2L and F2R with a time-lag, not simultaneously. Further, machine 10 can make an A-2 type, A-4 type, or A-5 type case, wherein the edges of the outer flaps deviate from the center line of the case, merely by changing the distance L2 through which the case is transported from the flap-folding stage to the case-sealing stage. As long as distance L2 is changed appropriately, one of the edges of the outer flaps of the A-2 type, A-4 type or A-5 type case is automatically aligned with the reference line Xsc when the case is placed on the case-sealing station.

According to the present invention, it suffices to adjust the positioning members 16 and 18 of magazine 14 only once in accordance with the size of the cardboard cases which are to be opened, shaped, and sealed. Therefore, it is easy to design machine 10 into a fully automatic one, wherein the positioning members are automatically adjusted in accordance with input data items which represent the length L, width W and depth D of the cardboard cases to be opened, shaped, and sealed.

The present invention is not limited to the embodiment described above. Needless to say, various changes and modifications can be made without departing the scope of the invention. For example, each cardboard case 12 can be transported in a straight path from magazine 14 to the flap-folding station, unlike in the above embodiment wherein arm 22 is rotated, thus transporting case 12 to the flap-folding station, so that machine 10 requires a smaller floor area than when case 12 is transported in a straight path. To transport case 12 in a straight path is advantageous in that no rotation moment is exerted on case 12, and hence case 12 assures a correct position on the flap-folding station.

According to the present invention, as has been explained in detail, suction cups hold each flat folded preassembled case, and the case is opened while being transported from the magazine to the flap-folding station. To be more precise, the upper-inner flap of the case is first folded downward, pushing left outer flap aside. Since both outer flaps are thus opened, the lower-inner flap is smoothly and quickly folded, causing no bridging at all. No bridging having been made, the inner flaps or the outer flaps are not distorted, torn, or broken, nor is the flap-folding process interrupted.

Further, in the case-assembling method according to the present invention, it suffices to adjust the positioning members to properly position each flat folded case on the magazine. No positional adjustment of the components is required at the flap-folding station or at the case-sealing station. Therefore, cardboard cases of different sizes can be opened, shaped, and sealed with a sufficiently high efficiency by means of this case-assembling method.

Moreover, since the reference lines of the magazine, the flap-folding station, and the case-sealing stage are parallel and set apart by predetermined distances, each cardboard case will be automatically positioned correctly at the flap-folding station and then at the case-sealing station, only if transported in the X-axis direction for these distances, provided that the case has been correctly positioned on the magazine. Since the distances need not be much longer than the width of the cardboard case, the case-assembling machine can have a small length as measured in the X-axis direction. In addition, since neither the flap-folding mechanism nor the case-sealing mechanism requires components for positioning the cardboard case, the case-assembling machine is simple, compact and light.

Furthermore, the case-opening mechanism, which comprises at least one suction cup and a flap-folding member, can open flat-folded case reliably. The case opening mechanism is relatively simple in structure, which also serves to simplify the case-assembling machine further.

What is claimed is:

1. A method of opening flat folded cases, comprising the steps of:

storing a plurality of flat-folded cases horizontally in a magazine, said flat-folded cases forming a pile of cases in said magazine;

lifting an uppermost case from said pile in said magazine at a magazine station, with an end panel of said uppermost case attracted to and held by a suction cup;

said suction cup being mounted on a shaft which is slidably supported in a vertical direction on a pivotable arm, and wherein a spring means is coupled to the shaft to press the suction cup onto said end panel of said uppermost case;

said step of lifting an uppermost case comprising raising said pivotable arm and applying a compression force on said suction cup by means of said spring means such that said compression force applied on said suction cup decreases as said rotatable arm rises to lift said uppermost case;

forming a gap between said uppermost case and a next lower case as said uppermost case is lifted, thereby allowing air to flow in said gap in an increasing amount as said gap increases during said lifting, to prevent lifting of said next lower case with said uppermost case;

folding a bottom upper-inner flap of the end panel of said uppermost case downward at the same time said uppermost case is being lifted, while pressing said suction cup onto the end panel by said compression force;

transferring said uppermost case from said magazine station to a flap-folding station after said bottom upper-inner flap is folded downward so as to open the case in preparation for subsequent folding of other bottom flaps thereof;

folding a bottom lower-inner flap and a pair of bottom outer flaps of the opened case at said flap-folding station;

transferring the case from said flap-folding station to a sealing station; and sealing the folded bottom outer flaps of the case at said sealing station to form an erected open case.

2. The method according to claim 1, wherein the lifting step comprises lifting said uppermost case against the weight of a roller contacting a side panel of said uppermost case.

3. The method according to claim 1, wherein said plurality of flat-folded cases in said pile are of the same size or different sizes and the center line of the end panel of each flat-folded case is aligned with a reference line Xo of said magazine station, the cases being continuously processed to open them one by one.

4. The method according to claim 1, wherein said folding of said bottom upper inner flap comprises rotating said bottom upper inner flap by 180° around the center of the end panel of said flat-folded case, with said end panel attracted to and held by the suction cup.

5. The method according to claim 1, where said magazine station is a shuttle-type of magazine station.

6. The method according to claim 1, wherein said magazine station is a rotary type of magazine station.

7. The method according to claim 1, wherein said pivotable arm is supported at a position separate from said magazine.

8. The method according to claim 1, wherein:

said flat-folded cases are placed in said magazine, with lower edges thereof aligned with a reference line Yo parallel to the transport direction of said cases, and with a center line of the end panels thereof aligned with a reference line Xo of said magazine;

said flap-folding station has a reference line Xfc parallel to the reference line Xo and spaced apart therefrom by a predetermined distance;

said sealing station has a reference line Xcs parallel to the reference line Xo and spaced apart therefrom by a predetermined distance; and the lower-inner flap of a case is folded, and the outer flaps thereof are then folded, while the case is at the flap-folding station with its lower edge aligned with the reference line Yo and the center line of its end panel aligned with the reference line Xfc.

9. The method according to claim 8, wherein:

said flat-folded case is transported from said magazine to said flap-folding station, with its end panel attracted to and held by the suction cup attached to the pivotable arm, by pivoting the arm over a predetermined angle; and said case is transported from said flap-folding station to said sealing station along a substantially straight path.

10. The method according to claim 8, wherein:

a first plate, which is movable up and down, is caused to contact a lower edge of the end panel of a case placed on said sealing station, and to also contact upper sides of left and right outer flaps of the case on said sealing station;

a second plate, which is movable horizontally, is moved to contact an upper-inner flap and outer flaps of the case, thereby pushing the case forward until the case abuts on a front guide, whereby opposing edges of the left and right outer flaps abut on each other; and a sealing means is applied to the abutting edges of the left and right flaps at the sealing station, thereby sealing the bottom of the case.

11. A method of opening flat folded cases, comprising the steps of:

storing a plurality of flat-folded cases horizontally in a magazine, said flat-folded cases forming a pile of cases in said magazine;

aligning a lower edge of a case horizontally stacked on said magazine with a first reference line Yo parallel to a transport direction of the case, and aligning a center line of an end panel of the case with a second reference line Xo intersecting with the first reference line Yo, so that flat-folded cases of different sizes can be handled;

lifting an uppermost case against a weight of a roller contacting a side panel of the case, with an end panel thereof attracted to and held by a suction cup;

folding a bottom upper-inner flap of the end panel downward about said lower edge at the same time the case is being lifted, said bottom upper-inner flap pushing open a lower one of bottom outer flaps during said folding of said bottom upper-inner flap;

folding a bottom lower-inner flap and bottom outer flaps of the case at a flap-folding station after moving the case a predetermined distance in said transport direction from said magazine to said flap-folding station; and sealing the folded bottom outer flaps of the case at a sealing station.

12. A machine for opening flat-folded cases, comprising:

means for horizontally storing a plurality of flat folded cases in a magazine, said flat-folded cases forming a pile of cases in said magazine;

lifting means for lifting an uppermost case stored horizontally in said magazine, and for folding downwardly a bottom upper-inner flap of an end panel of the case, thereby pushing open a bottom outer flap of the case and opening the case;

said lifting means including a suction cup means for attracting the end panel of the case end for lifting the case from said magazine; and a flap-folding member which pivots at the same time the case is being lifted so as to contact and push downwardly said bottom upper-inner flap, thereby folding the bottom upper-inner flap of the end panel downward and opening the case in its lifted state; said suction cup means including a shaft, a suction cup attached to the lower end of said shaft, and a compression spring means for pressing said suction cup onto the end panel, said spring means being wound around the shaft;

flap-folding means for folding a bottom lower-inner flap and outer flaps of the case after said case is opened in said lifted state; and means for sealing the folded outer flaps after being folded by said flap-folding means.

13. The machine according to claim 12, further comprising a roller means arranged for contacting with a side panel of said uppermost case and for preventing the side panel of said uppermost case from raising in its entirety while the case is being lifted.

14. The machine according to claim 13, wherein said roller means is mounted on a supporting member slidably supported in the vertical and horizontal directions on said magazine.

15. The machine according to claim 14, wherein said supporting member is supported by a slider which is slidably mounted on a vertical guide bar arranged on said magazine.

16. The machine according to claim 12, wherein said flap-folding member opens each flat-folded case after it has been rotated by 180° around the center of the end panel of the flat-folded case with the end panel attracted to and held by said suction cup.

* * * * *

UNITED STATES PATENT AND TRADEMARK OFFICE

CERTIFICATE OF CORRECTION

PATENT NO. : 5,024,640

DATED : June 18, 1991

INVENTOR(S) : T. SAITOH

It is certified that error appears in the above-identified patent and that said Letters Patent is hereby corrected as shown below:

Column 1, line 39, after "case", insert -- , --.

Column 3, line 6, after "center line of the", insert --flat--.

Column 18, line 4, change "on" to read --an--.

Column 18, line 56, delete one "case".

Column 19, line 22, after "35,", insert --a--.

Column 20, line 12, change "stage" to read --station--.

Column 20, line 13, change "stage" to read --station--.

Column 20, line 62, change "stage" to read --station--.

Column 21, line 10, change "case" to read --cases--.

Signed and Sealed this

Twentieth Day of April, 1993

*Attest:*

MICHAEL K. KIRK

*Attesting Officer*

*Acting Commissioner of Patents and Trademarks*